US007967104B2

(12) United States Patent
Carter

(10) Patent No.: US 7,967,104 B2
(45) Date of Patent: Jun. 28, 2011

(54) SHIPPABLE SPEAKER BOX

(76) Inventor: Keith Carter, Maricopa, AZ (US)

( * ) Notice: Subject to any disclaimer, the term of this patent is extended or adjusted under 35 U.S.C. 154(b) by 0 days.

(21) Appl. No.: 12/621,865

(22) Filed: Nov. 19, 2009

(65) Prior Publication Data

US 2011/0000740 A1 Jan. 6, 2011

Related U.S. Application Data

(63) Continuation-in-part of application No. 12/497,628, filed on Jul. 3, 2009.

(51) Int. Cl.
*A47B 81/06* (2006.01)

(52) U.S. Cl. ..... 181/199; 181/198; 220/4.29

(58) Field of Classification Search ..... 181/290, 181/148, 198, 199; 220/4.29
See application file for complete search history.

(56) References Cited

U.S. PATENT DOCUMENTS

| | | | | | |
|---|---|---|---|---|---|
| 701,576 | A * | 6/1902 | Kirshner | 220/4.26 |
| 3,887,101 | A * | 6/1975 | Adachi | 220/4.29 |
| 4,451,711 | A * | 5/1984 | Jackson | 381/335 |
| 4,984,653 | A | 1/1991 | Spors | |
| 5,056,618 | A * | 10/1991 | Prodan | 181/199 |
| 5,696,357 | A * | 12/1997 | Starobin | 181/156 |
| 5,979,591 | A * | 11/1999 | Harrison | 181/199 |
| 6,513,624 | B2 | 2/2003 | Coffin | |
| 6,744,902 | B2 * | 6/2004 | Proni | 381/386 |
| 7,506,721 | B2 | 3/2009 | Moore | |
| 2003/0213642 | A1 * | 11/2003 | Powell | 181/199 |
| 2006/0165248 | A1 | 7/2006 | Butcher et al. | |

* cited by examiner

*Primary Examiner* — Forrest M Phillips
(74) *Attorney, Agent, or Firm* — Keith L. Jenkins; Keith L. Jenkins, Registered Patent Attorney, LLC

(57) ABSTRACT

A speaker enclosure, or enclosure, and kit with plural linearly aligned panels connected by flexible couplings are shipped in a parallel stack with all the coupled panels still coupled during shipment, plus additional panels, also stacked parallel. The flexible couplings may be provided by a single sheet of flexible substrate coupled to the linearly aligned panels. One side of the assembled speaker enclosure includes a middle panel of the coupled panels, having at least one flat rabbet joint. The external length of the middle panel is long enough to permit folding of at least one of the outermost of the panels, with flexible substrate and a covering, under the middle panel. The assembled speaker enclosure is held together with a flexible substrate, adhesive, clamps, or preferably, any two thereof. Openings for speakers and connector cups are provided. The kit includes adhesive, instructions, at least one connector cup, and hardware.

24 Claims, 24 Drawing Sheets

SHIPPABLE SPEAKER BOX

RELATED APPLICATIONS

This application is a continuation-in-part of application Ser. No. 12/497,628 filed Jul. 3, 2009 having one common inventor.

FIELD OF THE INVENTION

The present invention relates to an enclosure, or cabinet, for a loudspeaker, wherein the enclosure has improved form for folding for shipment. The field of invention also relates to kits including the improved form, providing means to construct the shipped kit into a loudspeaker enclosure.

BACKGROUND OF THE INVENTION

Speaker enclosures have been known in art for many years, having a generally rectangular shape or having one sloped face. They are known to be covered in carpet or other fabric.

Continuing challenges in the art are to reduce the form factor for shipping and to increase the speed of assembly. Retail establishments that offer assembly services for their customers have very tight timelines for assemblies. For example, one major retailer allows only ten minutes to completely assemble a speaker enclosure, using untrained personnel.

US Patent Publication 2006/0165248 A1 to Butcher, et al. published Jul. 27, 2007 is a useful example of the challenges. Butcher shows four aligned panels held together with living hinges which are intended to fold up into a stack for shipping. In fact the four panels, as taught by Butcher, cannot fold up for shipping because of the nature of the joints that Butcher uses. Products have been sold, allegedly patent pending under Butcher's application, that have two sets of two panels flexibly connected by living hinges. The four-panel stack of Butcher cannot work.

Hence, there is a need for a speaker enclosure that can fold more sections completely and which can be quickly assembled by relatively unskilled personnel. There is also a need for a kit, based on a rapidly erectable speaker enclosure that contains all associated parts and hardware to allow construction of a speaker enclosure that is ready to receive a speaker. The present invention addresses these needs.

BRIEF SUMMARY OF THE INVENTION

An improved shippable speaker enclosure, including: five panels flexibly coupled in a linearly aligned sequence with four flexible couplings formed by a flexible substrate adhered to each of the five panels, including: a middle panel including four sides; first and second intermediate panels, each flexibly coupled to the middle panel on one of two opposite sides of the four sides, in the linearly aligned sequence; first and second outermost panels, each flexibly coupled to one respective the intermediate panel in the linearly aligned sequence; a covering adhered to the substrate; the five panels able to be folded together into a configuration where the first and second intermediate panels and the first and second outermost panels are stacked generally parallel to each other without uncoupling the four flexible couplings; a sixth panel, including a first side panel sized and shaped to be circumferentially engaged by the five panels; a seventh panel, including a second side panel sized and shaped to be circumferentially engaged by the five panels, where the five panels, the sixth panel, and the seventh panel include seven panels able to be assembled into the improved shippable speaker enclosure. The improved shippable speaker enclosure, further including a eighth panel able, in assembly of the speaker enclosure, to partition space interior to the speaker enclosure into at least two separate portions. The improved shippable speaker enclosure combined in a kit including: the five panels, folded into the configuration where four panels of the five panels are parallel and the four flexible couplings remain coupled; and the sixth and the seventh panels stacked parallel to the four parallel panels to form a stack. The improved shippable speaker enclosure, where the kit further includes: a fastener and a construction element. The improved shippable speaker enclosure, further including a covering adhered to the flexible substrate. The improved shippable speaker enclosure, where each of the five panels have a whole panel thickness, where the whole panel thickness includes the combined thickness of the panel plus a thickness of the flexible substrate adhered to the panel, plus a thickness of a covering; where the middle panel includes an external length greater than combined the thicknesses of the first and second outermost panels; and an external length less than external lengths of each of the first and second intermediate panels and each of the first and second outermost panels. The improved shippable speaker enclosure, where the first and second outermost panels have smaller external lengths than respective the first and second intermediate panels to which the first and second outermost panels are respectively flexibly coupled. The improved shippable speaker enclosure, where: a of the sixth panel and the seventh panel includes a connector cup opening; the kit further includes a connector cup sized, shaped, and arranged to fit securely within the connector cup opening; and a panel of the five panels includes a speaker opening. The improved shippable speaker enclosure, where the kit further includes a retail package: able to contain: the stack; the construction element; the connector cup; and the fastener; and bearing, on a surface of the retail package, text relating to the speaker enclosure and/or graphics relating to the speaker enclosure. The improved shippable speaker enclosure, where the construction element of the kit includes a of: an adhesive, able to at least adhere the side panels to the five panels; assembly hardware for mounting the assembled speaker enclosure; mounting a speaker within the speaker enclosure; and/or assembling the speaker enclosure; and a set of instructions illustrating and explaining how to assemble the speaker enclosure. The improved shippable speaker enclosure, further including first and second aligned grooves in each panel of the five panels, where the first and second grooves are configured to receive at least a portion of the first and the second side panels, respectively. The improved shippable speaker enclosure, further including a third groove across at least four panels of the seven panels, the third groove able to at least partially receive an eighth panel, where the eighth panel is able, when the speaker enclosure is assembled, to act as a partition interior to the speaker enclosure. The improved shippable speaker enclosure, where the four flexible couplings include one piece of flexible substrate coupled to at least four of the five panels.

An improved shippable speaker enclosure, including: five panels flexibly coupled in a linearly aligned sequence with four flexible couplings; where the five panels are able to be folded together into a stacked configuration where four panels of the five panels are stacked generally parallel to each other without uncoupling the four flexible couplings; where each of the five panels have a whole panel thickness including a thickness of the panel plus a thickness of the flexible substrate plus a thickness of a covering, where the covering is affixed to the panel or affixed to the substrate; where the five panels include: one middle panel having first and second sides; first and second intermediate panels flexibly coupled to the middle panel on respective first and second sides of the middle panel; first and second outermost panels flexibly coupled to respective first and second the intermediate panels to form the linearly aligned sequence; and where the middle panel includes: an external length greater than the sum of the whole panel thicknesses of the first and second outermost panels; an external length less than external lengths of each of the first and second intermediate panels and each of the first and second outermost panels; and where the first and second outermost panels have smaller external lengths than the respective first and second intermediate panels to which the first and second outermost panels are respectively flexibly coupled; a sixth panel, including a first side panel sized and shaped to be circumferentially engaged by the five panels; a seventh panel, including a second side panel sized and shaped to be circumferentially engaged by the five panels, where the five panels, the sixth panel, and the seventh panel include seven panels able to be assembled into the improved shippable speaker enclosure; first and second aligned grooves in each panel of the five panels, where the first and second grooves are configured to receive at least a portion of the first and the second side panels, respectively, where the sixth panel or the seventh panel includes a connector cup opening; where the first and/or second intermediate panels and the first and/or second outermost panels includes a speaker opening; where the five panels are able to be folded to form the speaker enclosure by: circumferentially engaging edges of the sixth and the seventh panels; and being secured thereto with: adhesive, able to adhere the sixth and seventh side panels to the five panels and/or a fastener, able to secure the speaker enclosure in an assembled state; where the five panels are able to be folded for shipping into the stacked configuration and the sixth panel and the seventh panel are able to be stacked parallel and adjacent to the five folded panels to form a stack. The improved shippable speaker enclosure, further including a third groove across at least four panels of the seven panels, the third groove able to receive an eighth panel, where the eighth panel is able, when the speaker enclosure is assembled, to act as a partition interior to the speaker enclosure. The improved shippable speaker enclosure, combined in a kit including the stack and a retail package containing the stack. The improved shippable speaker enclosure, where the kit further includes a construction element including: the adhesive, able to at least adhere the side panels to the five panels; assembly hardware for: mounting the assembled speaker enclosure; mounting a speaker within the speaker enclosure; and assembling the speaker enclosure; and a set of instructions illustrating and explaining how to assemble the speaker enclosure; and the fastener, able to secure the speaker enclosure in an assembled state.

An improved shippable speaker enclosure, including: five panels flexibly coupled in a linearly aligned sequence with four flexible couplings, where the four flexible couplings include one piece of flexible substrate coupled to the five panels; where the five panels are able to be folded together into a folded configuration where four panels of the five panels are stacked generally parallel to each other without uncoupling the four flexible couplings; the five linearly arranged panels include: one middle panel including first and second opposing sides; first and second intermediate panels flexibly coupled to the middle panel on the respective first and second opposing sides of the middle panel; first and second outermost panels flexibly coupled to respective the first and second intermediate panels to form the linearly aligned sequence; and where the middle panel includes: an external length at least as great as the sum of whole panel thicknesses of each of the first and second outermost panels combined, where the whole panel thickness includes a thickness of the panel plus a thickness of the substrate plus a thickness of the covering; an external length less than external lengths of each of the first and second intermediate panels and each of the first and second outermost panels; the first and second outermost panels each further including a smaller external length than the respective first and second intermediate panel to which each first and second outermost panel is coupled; a sixth panel, including a first side panel sized and shaped to be circumferentially engaged by the five panels; a seventh panel, including a second side panel sized and shaped to be circumferentially engaged by the five panels, where the five panels, the sixth panel, and the seventh panel include seven panels able to be assembled into the improved shippable speaker enclosure; where the five panels include first and second aligned grooves in each panel of the five panels, where the first and second aligned grooves are configured to receive a portion of the first and the second side panels, respectively, where one of the sixth panel and the seventh panel includes a connector cup opening; where at least one of the five panels includes a speaker opening sized, shaped, and located to receive a speaker; where the five panels are able to be folded about the flexible couplings to form the speaker enclosure by: circumferentially engaging the sixth and the seventh panels; and being secured thereto by a fastener including a attachable alignment frame; where the five panels are able to be folded about the flexible couplings into the folded configuration and the sixth panel and the seventh panel are able to be stacked parallel and adjacent to the five folded panels to form a stack; the stack combined in a kit further including: the fastener, able to secure the speaker enclosure in an assembled state; the connector cup, able to provide electrical connections between a speaker and an audio signal source; and at least one of: the adhesive, able to adhere the sixth and seventh side panels to the five panels; assembly hardware for at least one of: mounting the assembled speaker enclosure; mounting a speaker within the speaker enclosure; and assembling the speaker enclosure; and a set of instructions illustrating and explaining how to assemble the speaker enclosure; and a retail package, able to contain the stack, the fastener, the assembly hardware, and the set of instructions. The improved shippable speaker enclosure, further including: an eighth panel able, when the speaker enclosure is assembled, to partition space within the assembled speaker enclosure; and a third aligned grove across four panels of the seven panels, able to receive at least a portion of the eighth panel.

BRIEF DESCRIPTION OF THE DRAWINGS

The above and other objects and advantages of the present invention will become more apparent from the following description taken in conjunction with the following drawings in which.

DETAILED DESCRIPTION OF THE DRAWINGS

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
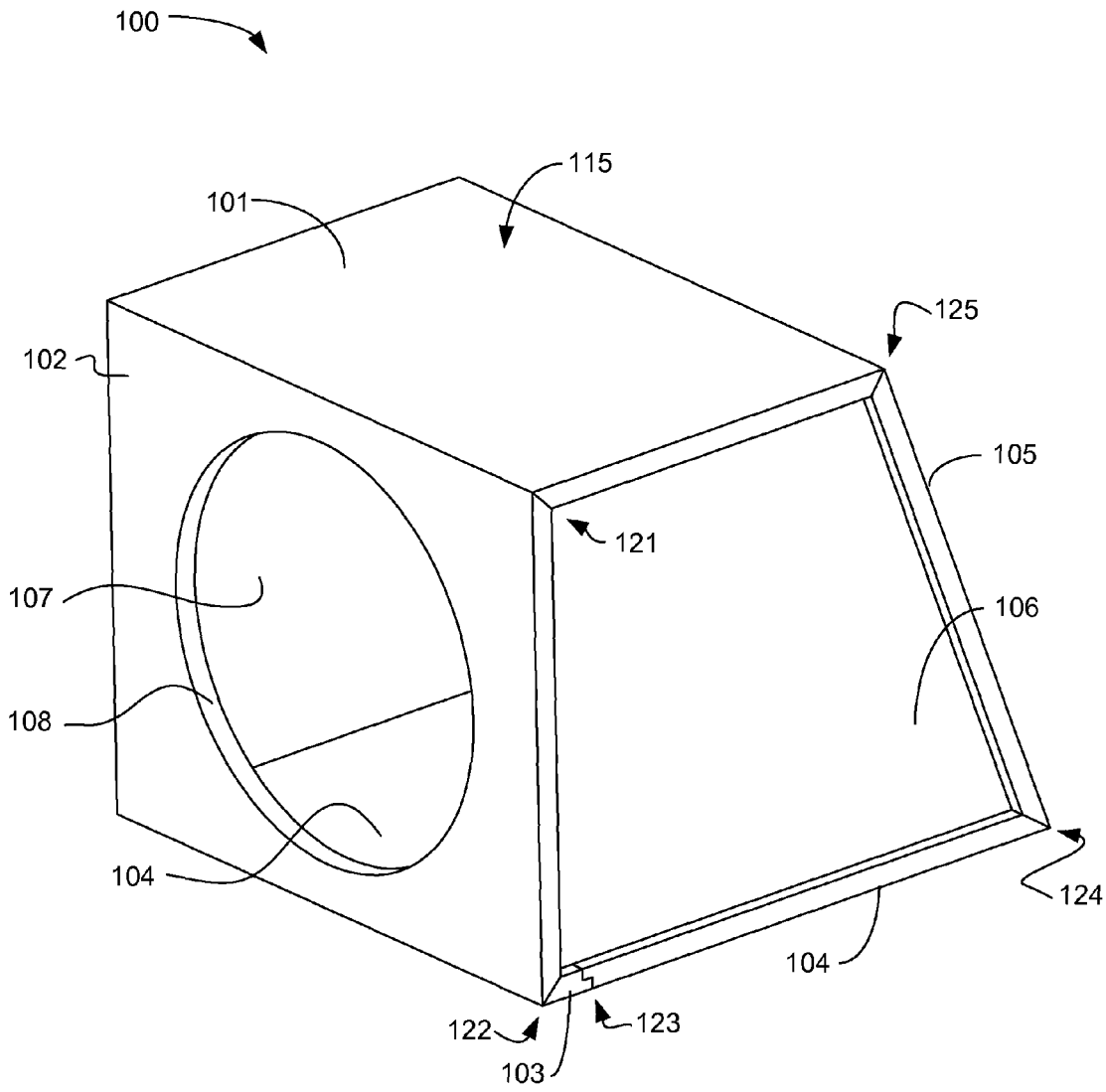
FIG. 1 is a front perspective view illustrating some aspects of the assembled improved shippable speaker enclosure, according to a first exemplary embodiment of the present invention.

FIG. 1 is a front perspective view illustrating some aspects of the assembled improved shippable speaker enclosure 100, according to an exemplary embodiment of the present invention. The improved shippable speaker enclosure 100 includes a flexibly coupled set of five panels 101, 102 103, 104, and 105 in a linearly aligned sequence and first and second side panels 106 and 107. Panels 101, 102 103, 104, 105, 106 and 107 may be wood, composite, or other material. Materials with some acoustic damping properties, to reduce cabinet buzz, are preferred. Second outermost panel 101 is the top of the assembled improved shippable speaker enclosure 100, and is flexibly coupled at mitered joint 121 to second intermediate panel 102, which is the front panel. Second intermediate panel 102 has a speaker opening 108 for receiving a speaker. The speaker opening 108 may include screw holes (not shown), or other fastener-assisting devices or assembly hardware, to assist in mounting the speaker inside the improved shippable speaker enclosure 100. Speaker opening 108 is shaped to compliment the speaker. The speaker is not included in this embodiment. In an alternate embodiment, the improved shippable speaker enclosure 100 may be sold with a speaker. In yet another embodiment, the improved shippable speaker enclosure 100 may be sold fully assembled.

Second intermediate panel 102 is flexibly coupled to short middle panel 103 at mitered joint 122. Short middle panel 103 enables stack folding of four panels 101, 102, 104, and 105 of the five panels 101, 102, 103, 104, and 105. Short middle panel 103 is flexibly coupled to bottom first intermediate panel 104 at flat mitered rabbet joint 123. Short middle panel 103 and bottom first intermediate panel 104 form the bottom of improved shippable speaker enclosure 100. First intermediate panel 104 is flexibly coupled to first outermost panel 105, the back panel, at acutely mitered joint 124. First outermost panel 105 is joined, during assembly, as will be discussed further below, to top outermost panel 101. Preferably, the five panels 101, 102, 103, 104, and 105 are flexibly coupled by a single sheet of covering 115 that may cover up to all of the external surfaces of panels 101, 102, 103, 104, and 105. In various alternate embodiments, other flexible couplings may be used. As will be discussed in greater detail below, a substrate 506 is preferred as the flexible coupling material, allowing coverings 115 or 508 that may otherwise lack the strength or flexibility for acting as couplings, but which have superior appearance. With separate sheets for first and second side panels 106 and 107, covering 115 covers the exterior surfaces of all panels 101, 102, 103 104, 105, 106, and 107. For simplicity of illustration in FIGS. 1-4, the thickness of the covering 115 is not shown. Two panels, middle panel 103 and first intermediate panel 104, are joined with a flat rabbet joint 123 to form one bottom surface of the improved shippable speaker enclosure 100.

First side panel 106 has an isosceles trapezoidal shape and is circumferentially engaged by the five panels 101, 102, 103, 104, and 105. Four of the joints 121, 122, 124, and 125 between the five panels 101, 102, 103, 104, and 105 coincide with corners of the first side panel 106. Second side panel 107 is a mirror image of first side panel 106 and is also circumferentially engaged by the five panels 101, 102, 103, 104, and 105. When assembled together, the seven panels 101, 102, 103, 104, 105, 106, and 107 form assembled improved shippable speaker enclosure 100.

Figure 2:
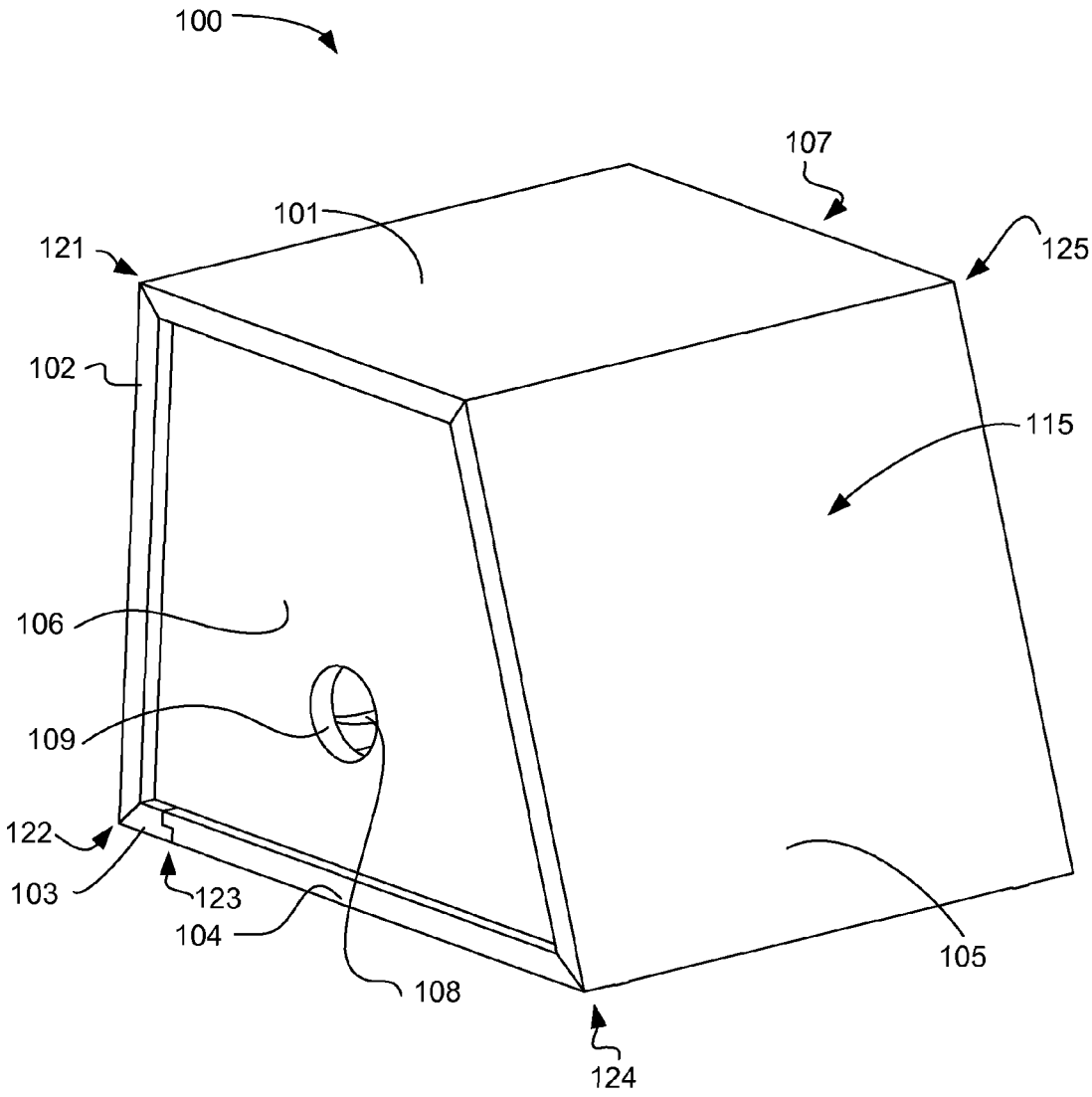
FIG. 2 is a rear perspective view illustrating additional aspects of the assembled improved shippable speaker enclosure of FIG. 1, according to an exemplary embodiment of the present invention.

FIG. 2 is a rear perspective view illustrating additional aspects of the assembled improved shippable speaker enclosure 100 of FIG. 1, according to an exemplary embodiment of the present invention. First side panel 106 is shown with connector cup opening 109, which receives a connector cup 1102 (see FIG. 11). Connector cup 1102 fits into connector cup opening 109 to provide wire leads inside the speaker enclosure 100 for conducting an audio signal from an audio source to the speaker. The connector cup 1102 may press fit into opening 109 or may be screw mounted. Those of skill in the art, enlightened by this disclosure, will be aware of the various types and substitutes for the connector cup 1102, all of which are within the scope of the present invention. The wire leads of connector cup 1102 couple to the audio signal terminals of the speaker, when installed, and provide external terminals for an audio amplifier, or other audio signal source, in the recess of the cup, accessible from the outside of assembled improved shippable speaker enclosure 100.

Figure 3:
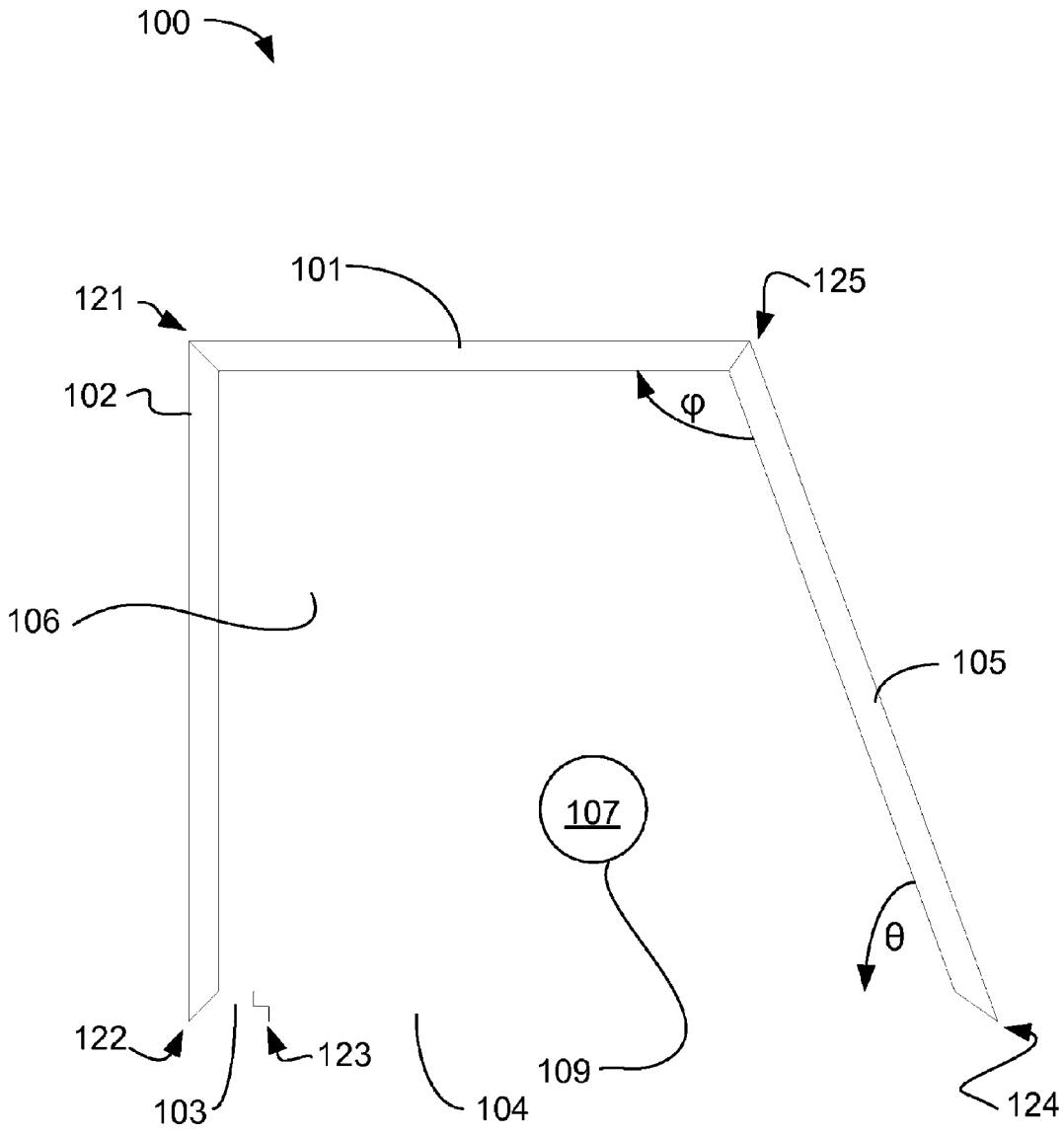
FIG. 3 is a side elevation view illustrating aspects of the assembled improved shippable speaker enclosure of FIG. 1, according to an exemplary embodiment of the present invention.

FIG. 3 is a side elevation view illustrating aspects of the assembled improved shippable speaker enclosure 100 of FIG. 1, according to an exemplary embodiment of the present invention. Acute angle $\theta$ and obtuse angle $\phi$ are supplementary angles and define the miter angles $\theta$ and $\phi$. The angles $\theta$ and $\phi$ may be chosen based upon acoustic principles within the constraints of folding dimensions, as discussed in more detail below. Note that the external length 604 (see FIG. 6) of first intermediate panel 104 is slightly greater than or equal to the external length 605 of first outermost panel 105, which is important to the folding scheme discussed in more detail below. It is also important that the exterior length 601 of second outermost panel 101 be no greater than the external length 602 of second intermediate panel 102.

Figure 4:
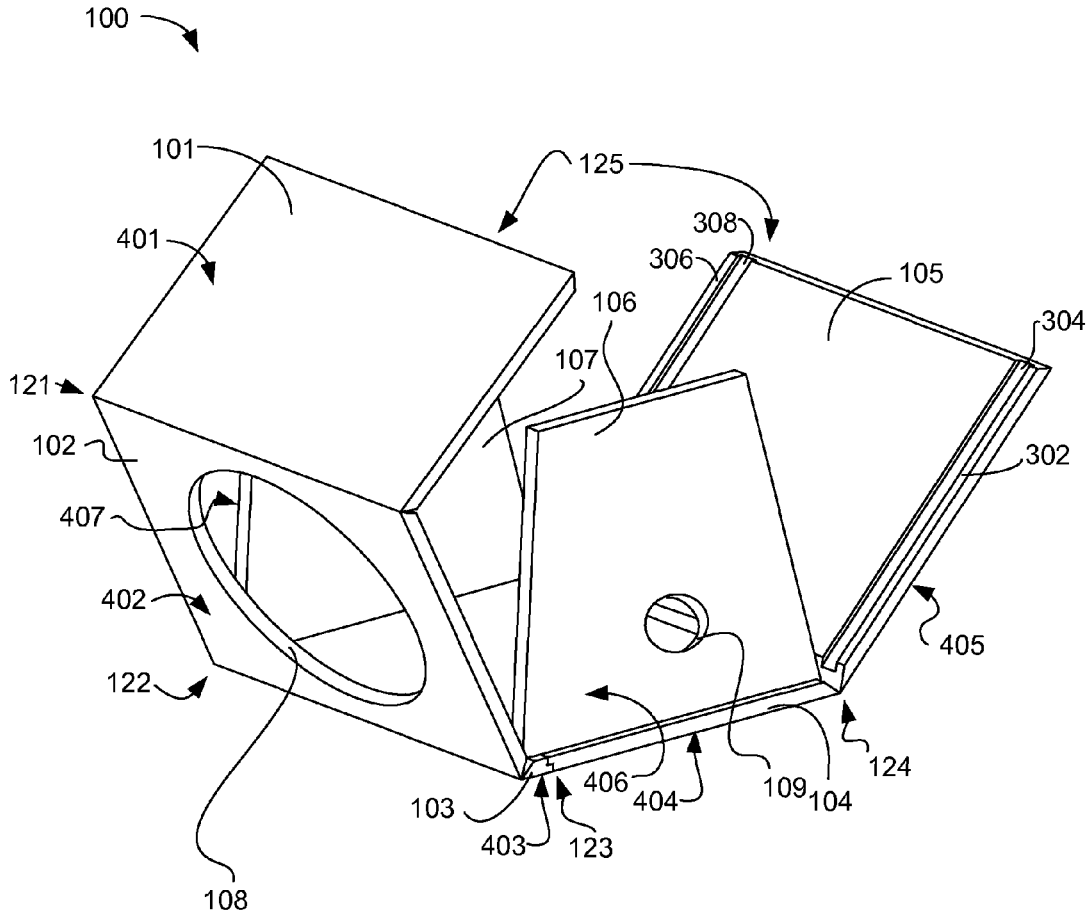
FIG. 4 is a front perspective view illustrating some aspects of the partially assembled improved shippable speaker enclosure of FIG. 1, according to an exemplary embodiment of the present invention.

FIG. 4 is a front perspective view illustrating some aspects of the partially assembled improved shippable speaker enclosure 100 of FIG. 1, according to an exemplary embodiment of the present invention. First and second aligned grooves 304 and 308, illustrated here as rectangular channels, but not so limited in the invention, extend in an aligned fashion into and across each of the five panels 101, 102, 103, 104, and 105. The first and second grooves 304 and 308 receive edge portions of the first and second side panels 106 and 107, respectively, as first and second side panels 106 and 107 are circumferentially engaged by the five panels 101, 102, 103, 104, and 105. Groove 304 is set inward from the edge of the five panels 101, 102, 103 104, and 105 by a rim 302. Groove 308 is set inward from the edge of the five panels 101, 102, 103, 104, and 105 by a rim 306. In the present embodiment, first and second aligned grooves 304 and 308 have the same widths, but the invention is not so limited. In the present embodiment, rims 302 and 306 have the same widths, but the invention is not so limited. The edge portions of first and second side panels 106 and 107 that are received by the first and second aligned grooves 304 and 308 are preferably not covered by covering 115 or 508.

Acutely mitered joint 124 and mitered joint 122 are shown open, and illustrate that the groove 304 extends the full length of panel 105, 104, and 103. The groove 304 extends as the full length of panels 102 and 101 (not visible in this view) as well. Mitered joint 125 is open and is shown as two surfaces, but is not flexibly coupled by substrate 506. Rather, joint 125 is fastened together during assembly using assembly hardware and/or adhesive. Assembly hardware may include any conventional fasteners and preferably includes screws in predrilled holes with plastic inserts for receiving screws, as are known in the art of fastening. External surfaces 401, 402, 403, 404, 405, 406, and 407 of panels 101, 102, 103, 104, 105, 106, and 107, respectively, are identified for reference in discussions below.

Figure 5:
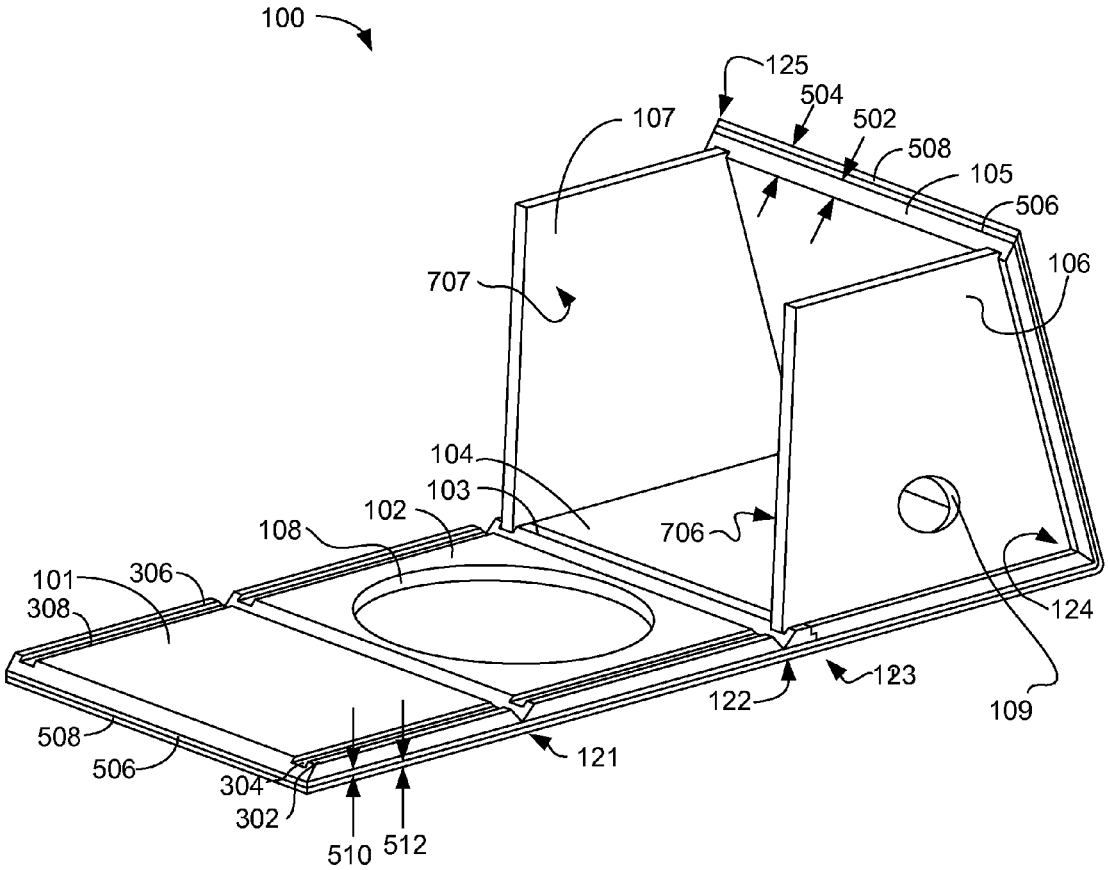
FIG. 5 is a front perspective view illustrating some aspects of the partially assembled embodiment of an improved shippable speaker enclosure of FIG. 1, and further illustrating a flexible substrate and covering, according to an exemplary embodiment of the present invention.

FIG. 5 is a front perspective view illustrating some additional aspects of the partially assembled improved shippable speaker enclosure 100 of FIG. 1, and further illustrating a flexible substrate 506 and covering 508, according to an exemplary embodiment of the present invention. First and second aligned grooves 304 and 308 are shown in second outermost panel 101 and second intermediate panel 102, and can be partially seen in middle panel 103. Likewise, rims 302 and 306 are shown in second outermost panel 101 and second intermediate panel 102, and can be partially seen in middle panel 103. The depth of first and second aligned grooves 304 and 308 is preferably less than one-half the panel thickness 502 of a panel 101, 102, 103, 104, or 105. Panels 101, 102, 103, 104, or 105 preferably all have the same panel thickness 502, but the invention is not so limited. Internal surface 706 of panel 106 and internal surface 707 of panel 107 are identified for reference in discussions below.

Flexible substrate 506 is adhered or otherwise affixed to the exterior surfaces 401, 402, 403, 404, and 405. In manufacturing, the flexible substrate 506 may be adhered to cover a main panel from which the five panels 101, 102, 103, 104, and 105 are cut, before the cutting takes place. Flexible substrate 506 is preferably a tough, flexible fabric, such as nylon cloth. Covering 508 is preferably decorative and easily cleaned, as well as being flexible. In manufacturing, the covering 508 may be adhered to cover the substrate 506 before panel cutting takes place. In preferred embodiments, the aligned adjacent edges of each of the five panels 101, 102, 103, 104, and 105 are touching, or have only a very slight gap between them. The covering 508 is preferably flexible or gathered enough to extend around the corners formed by joints 121, 122, and 124. In a particular embodiment, where the covering 508 is required, for non-structural reasons, to be a covering that is not flexible, the covering may be gathered, as is known in the art of sewing, along the corners formed by joints 121, 122, and 124 in order to provide adequate covering 508 to enable the joints 121, 122, and 124 to bend without stretching the covering 508.

The speed of assembly is greatly improved by having the five panels 101, 102, 103, 104, and 105 coupled together in a linearly aligned sequence that can be unfolded from the shipping stack 900 (see FIG. 9) and quickly refolded around the circumferences of the first and second side panels 106 and 107. The joints 121, 122, 123, 124, and 125 properly align without special effort due to the combination of first and second aligned grooves 304 and 308 and the flexible coupling of the substrate 506.

In the stage of assembly illustrated in FIG. 5, panels 103, 104, and 105 have been engaged on the circumference of panels 106 and 107. Preferably, adhesive 1106 (see FIG. 11) is applied in the first and second aligned grooves 304 and 308 before the first and second panels 106 and 107 are engaged. Adhesive 1106 is preferably also applied to the joints 121, 122, 123, 124, and 125, as improved shippable speaker enclosure 100 is assembled. Care should be taken not to overuse the adhesive 1106, as leakage to the outside may mar the appearance of the improved shippable speaker enclosure 100. Those of skill in the art, enlightened by this disclosure, will appreciate the various adhesives 1106 appropriate for this application, and its dependency on the type of panel materials. In an alternate embodiment, the adhesive 1106 may be a two-sided adhesive tape. In yet another embodiment, the adhesive 1106 may be an elastomeric adhesive tape that provides damping and adhesion. In still yet another embodiment, an acoustic damping material may be adhered into first and second aligned grooves 304 and 308, and then first and second side panels 106 and 107 may be adhered to the acoustic damping materials in the first and second aligned grooves 304 and 308.

As joint 124 is formed, as shown, flexible substrate 506 and flexible covering 508 extend around the corner formed by the joint 124. In some embodiments, substrate may be adhered to each of the five panels 101, 102, 103, 104, and 105 along the edges forming joint 125 and on a middle section of each panel, parallel to the joint, to maximize the amount of flexible substrate that can flex when joints 121, 122, and 124 are formed. In a particular variation of that particular embodiment, the substrate is adhered to first and second intermediate panels 102 and 104 distal to short panel 103, allowing the flexible substrate 506 to stretch from the middle of panel 102 to short panel 103 and from the middle of panel 104 to short panel 103 when forming joint 122.

Panel thickness 502 (not shown to scale) is an important design factor, as will be discussed further below. In embodiments in which the combined thicknesses of substrate 506 and covering 508 (not shown to scale) are significant, whole panel thickness 504, being the sum of panel thickness 502, substrate thickness 510, and covering thickness 512, becomes an important design factor, as well.

Figure 6:
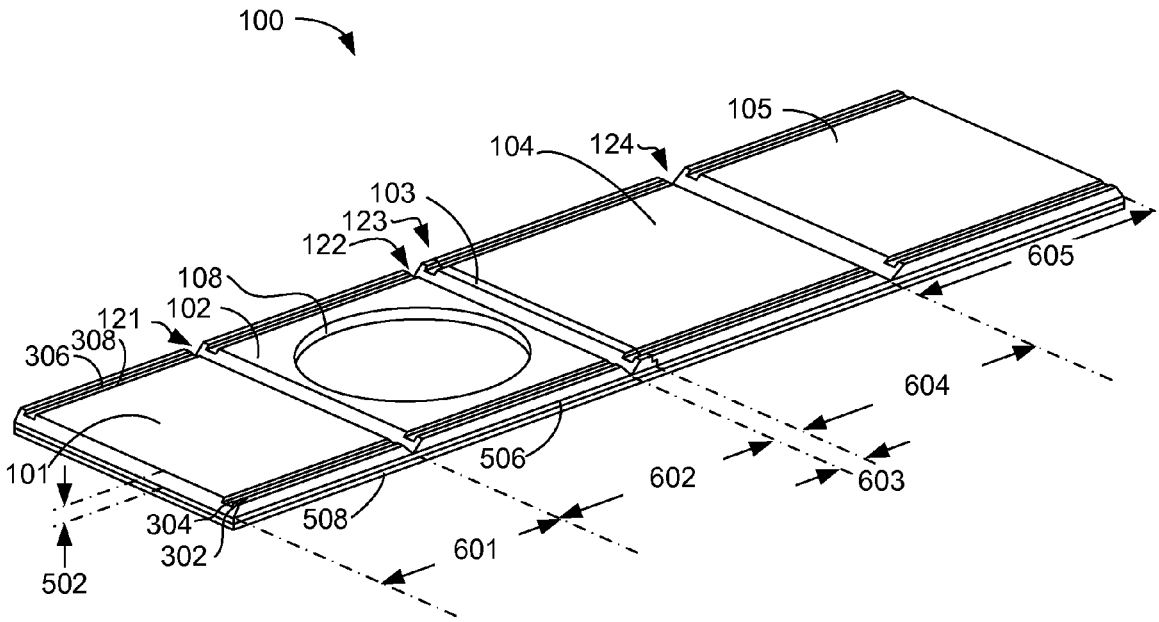
FIG. 6 is a front perspective view illustrating aspects of the five-panel foldable portion of the improved shippable speaker enclosure of FIG. 1 and FIG. 5, according to an exemplary embodiment of the present invention.

FIG. 6 is a front perspective view illustrating aspects of the five-panel 101, 102, 103, 104, and 105 foldable portion of the improved shippable speaker enclosure 100 of FIG. 1, according to an exemplary embodiment of the present invention. The panels 101, 102, 103, 104, and 105 are shown with their interior surfaces up. The panels 101, 102, 103, 104, and 105 are constructed in a linearly aligned sequence, and first aligned groove 304 and second aligned groove 308 are likewise aligned across panels 101, 102, 103, 104, and 105. The alignment of panels 101, 102, 103, 104, and 105 is maintained by substrate 506. Carpet is a popular covering 508, but the invention is not so limited. Other coverings 508 may be used, such as leather, padded fabrics, chain mail, and the like. Other approaches to flexible couplings may be used. In a physically demanding embodiment, piano hinges may be used, preferably with acoustic damping in the joints 121, 122, 123, and 124.

The view of FIG. 6 is the view of the five panels 101, 102, 103, 104, and 105 as they come off the assembly line in a linearly aligned sequence. Initially one piece of main panel material, the main panel is cut to size, first and second aligned grooves 304 and 308 are cut into the remaining panel, and the angled mitered joints 121, 122, 124, and 125, as well as the rabbet joint 123, of panel 104 are cut. The short middle panel 103 is cut and mitered for the angled miter joint 122 on one end and the flat rabbet joint 123 on the other. The panels 101, 102, 103, 104, and 105 are aligned and the substrate 506 is applied. In an alternative embodiment, without the rabbet joint 123, the substrate 506 is applied after the main panel material is cut.

Short middle panel 103 has two opposite sides for coupling first and second intermediate panels 104 and 102. Short middle panel 103 is flexibly coupled to first intermediate panel 104 using a flexibly coupled flat rabbet joint 123. First intermediate panel 104 is flexibly coupled to first outermost panel 105 using a flexibly coupled mitered joint 124. Short middle panel 103 is flexibly coupled to second intermediate panel 102 using a flexibly coupled mitered joint 122. Second intermediate panel 102 is flexibly coupled to second outermost panel 101 using a flexibly coupled mitered joint 121. The four flexible couplings 121, 122, 123, and 124 are preferably made by affixing a single sheet of substrate 506 over the surfaces of the improved shippable speaker enclosure 100 that will become exterior surfaces after assembly. Carpet is a popular covering 508 for such flexible couplings 121, 122, 123, and 124, but the invention is not so limited.

External lengths 601, 602, 603, 604, and 605 of panels 101, 102, 103, 104, and 105, respectively, and panel thickness 502 have important relationships. Preferably, the thickness 502 of panels 101, 102, 103, 104, and 105 are the same, but the invention is not so limited. The length 603 of short middle panel 103 must be at least as great as the combined thicknesses 502 of the first and second outermost panels 101 and 105. Preferably, the length 603 of short middle panel 103 is slightly longer than the necessary minimum of the combined thicknesses 502 of the first and second outermost panels 101 and 105. If the relationship between the length 603 of the short middle panel 103 and the combined thicknesses 502 of the first and second outermost panels 101 and 105 does not comply with the requirement stated, stacking panels 101, 102, 104, and 105 with four flexible couplings at joints 121, 122, 123, and 124 intact will be impossible. Where whole-panel thickness 504 is significantly larger than panel thickness 502, the length 603 of middle panel 103 must be at longer than two times longer than whole panel thicknesses 504 (see FIG. 5) of first and second outermost panels 101 and 105.

Length 601 of second outermost panel 101 must be no longer than, and is preferably slightly less than, the length 602 of adjacent second intermediate panel 102. Likewise, length 605 of first outermost panel 105 must be no longer than, and is preferably slightly less than, the length 604 of adjacent first intermediate panel 104. If the size relationship between first and second intermediate panels 102, 104, and their respective flexibly coupled first and second outermost panels 101, 105 is not enforced, stacking the panels 101, 102, 104, and 105 with the flexible couplings intact will be impossible.

Figure 7A:
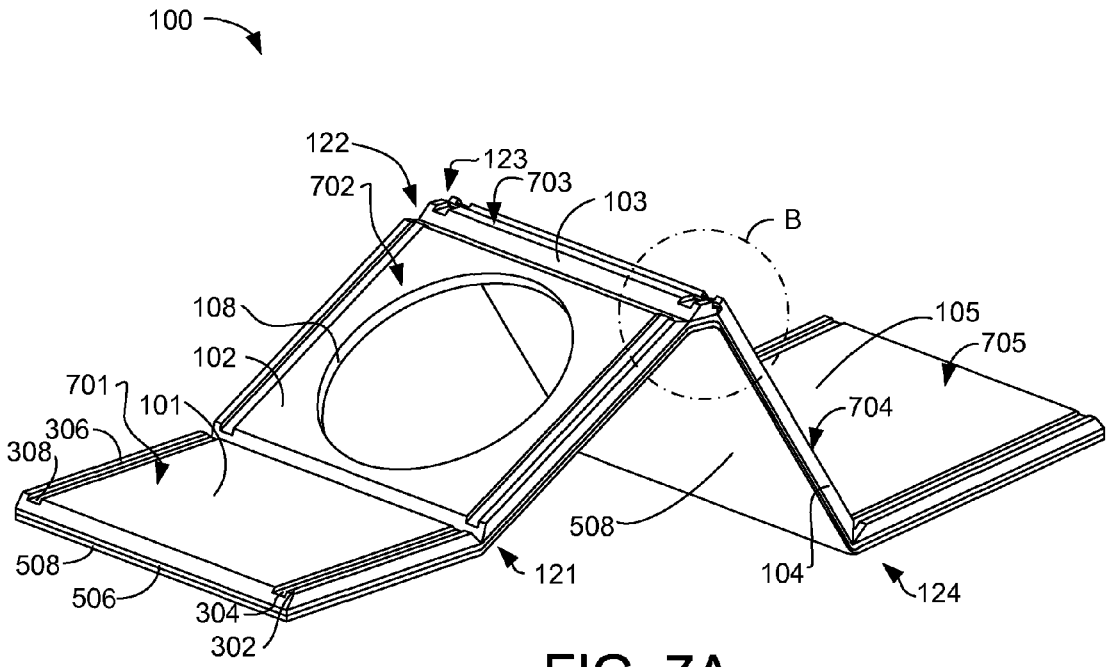
FIG. 7A is a front perspective view illustrating aspects of the five-panel foldable portion of the improved shippable speaker enclosure of FIG. 1 and FIG. 5 in a partially folded configuration, designating detail B, according to an exemplary embodiment of the present invention.

FIG. 7A is a front perspective view illustrating aspects of the five-panel 101, 102, 103, 104, and 105 foldable portion of the improved shippable speaker enclosure 100 of FIG. 1 in a partially folded configuration, designating detail B, according to an exemplary embodiment of the present invention. In a first stage of folding for shipping, panels 101, 102, 103, 104, and 105 are raised by the short middle panel 103, causing flexing of the joints 121, 122, 123, and 124. Internal surfaces 701, 702, 703, 704, and 705 of panels 101, 102, 103 104, and 105, respectively, are identified for reference in discussions below.

Figure 7B:
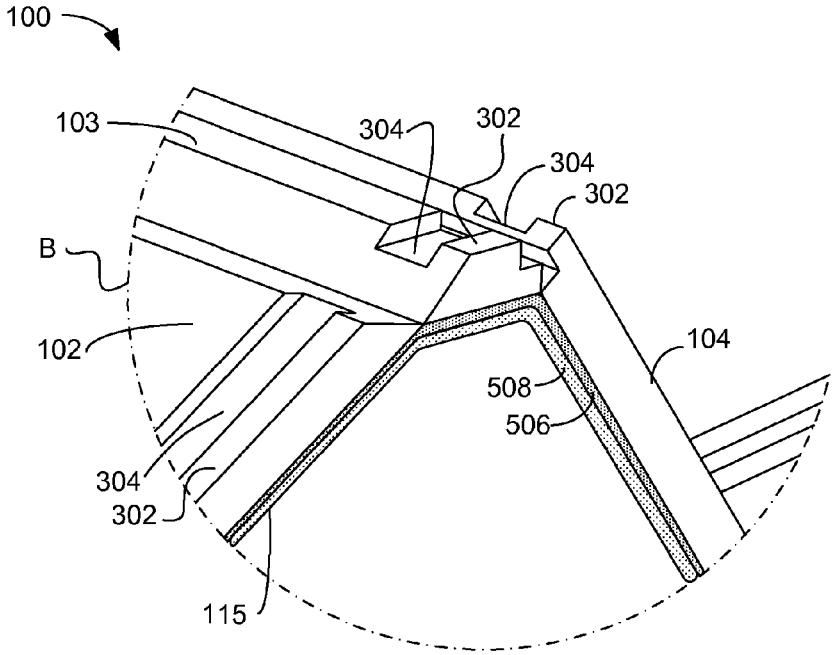
FIG. 7B is a front perspective view illustrating detail B, from FIG. 7A, of the five-panel foldable portion of the improved shippable speaker enclosure of FIG. 1 and FIG. 5 in a partially folded configuration, according to an exemplary embodiment of the present invention.

FIG. 7B is a front perspective view illustrating detail B, from FIG. 7A, of the five-panel 101, 102, 103, 104, and 105 foldable portion of the improved shippable speaker enclosure 100 of FIG. 1 in a partially folded configuration, according to an exemplary embodiment of the present invention. Detail B shows the flexing of the rabbet joint 123 between short middle panel 103 and bottom first intermediate panel 104 and the flexing of mitered joint 122 between short middle panel 103 and second intermediate panel 102. The layer of substrate 506 and covering 508 are in better view in detail B.

The flat rabbet joint 123 is a preferred joint that can be rotated at one outer edge. In a lesser preferred embodiment, a flat butt joint may be used, which simplifies manufacture (simple saw cut) but reduces structural stability. In a yet lesser preferred embodiment, a mitered joint, similar to joints 121 and 122, may be used, which simplifies manufacture (using the same router tool to make all mitered joints) but reduces structural stability even more, and requires cosmetic compensation to deal with the notch left on the exterior rim at the joint between short middle panel 103 and bottom first intermediate panel 104. The flat rabbet joint 123 is more complex to manufacture but gives excellent structural integrity and requires no cosmetic compensation.

Figure 8A:
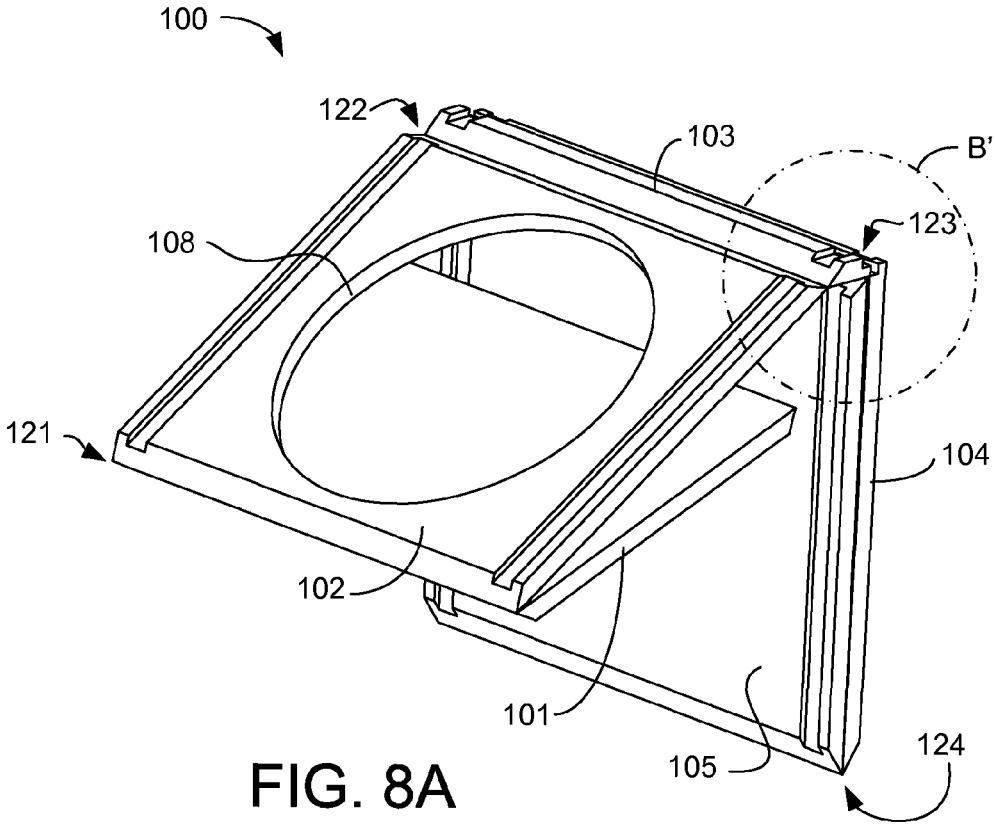
FIG. 8A is a front perspective view illustrating the five-panel foldable portion of the improved shippable speaker enclosure of FIG. 1 in a further partially folded configuration, designating detail B', according to an exemplary embodiment of the present invention.

FIG. 8A is a front perspective view illustrating the five-panel 101, 102, 103, 104, and 105 foldable portion of the improved shippable speaker enclosure 100 of FIG. 1 in a further partially folded configuration, designating detail B', according to an exemplary embodiment of the present invention. First intermediate panel 104 and first outermost panel 105 are folded into a folded configuration in which they are parallel and adjacent to one another. This illuminates the point that the length 603 of short middle panel 103 is chosen, in part, to make a foldable size relationship between first intermediate panel 104 and first outermost panel 105. If the length 605 of first outermost panel 105 is longer than the length 604 of first intermediate panel 104, then the folding shown in FIG. 8A would fail, as the outer edge of the first outermost panel 105 would impact middle panel 103. The same situation applies in regard to second intermediate panel 102 being at least as long as second outermost panel 101 for successful folding. The external lengths 603, 604, and 605 of panels 103, 104, and 105, respectively, should be predetermined to allow back first outermost panel 105 to fold to a position adjacent and parallel to bottom first intermediate panel 104. If short middle panel 103 is too long, first intermediate (bottom) panel 104 may be shorter than first outermost (back) panel 105 (holding the length of the bottom of the speaker enclosure, as assembled, constant), preventing first outermost panel 105 from folding into the position shown. Accordingly, the external length 603 of short middle panel 103 should be selected to make first intermediate panel 104 longer than first outermost panel 105. It should further be appreciated that the angles θ and ϕ, if not determined in light of folding constraints, may result in external lengths 605 and 604 of first outermost panel 105 and first intermediate panel 104, respectively, that are inconsistent with successful folding.

Second outermost (top) panel 101 is partially folded under second intermediate (front) panel 102. It can be seen that the external length 601 of second outermost panel 101 must be less than the external length 602 of second intermediate panel 102 for the fold to be ultimately successful. Note that the panels 101 and 102 as well as panels 104 and 105 have their external surfaces 401 and 402 adjacent, as well as external surfaces 404 and 405 adjacent. Their internal surfaces 701, 702, 703, 704 and 705, ultimately hidden after assembly, are outward to receive any blemishes that may accrue during handling and shipping. In a particular embodiment where the covering 508 (not shown in this view) is particularly subject to blemishes by rubbing, such as with a glossy polymeric fabric, a protective sheet may be inserted between the adjacent panels 101 and 102, or between adjacent panels 104 and 105 during shipping.

Figure 8B:
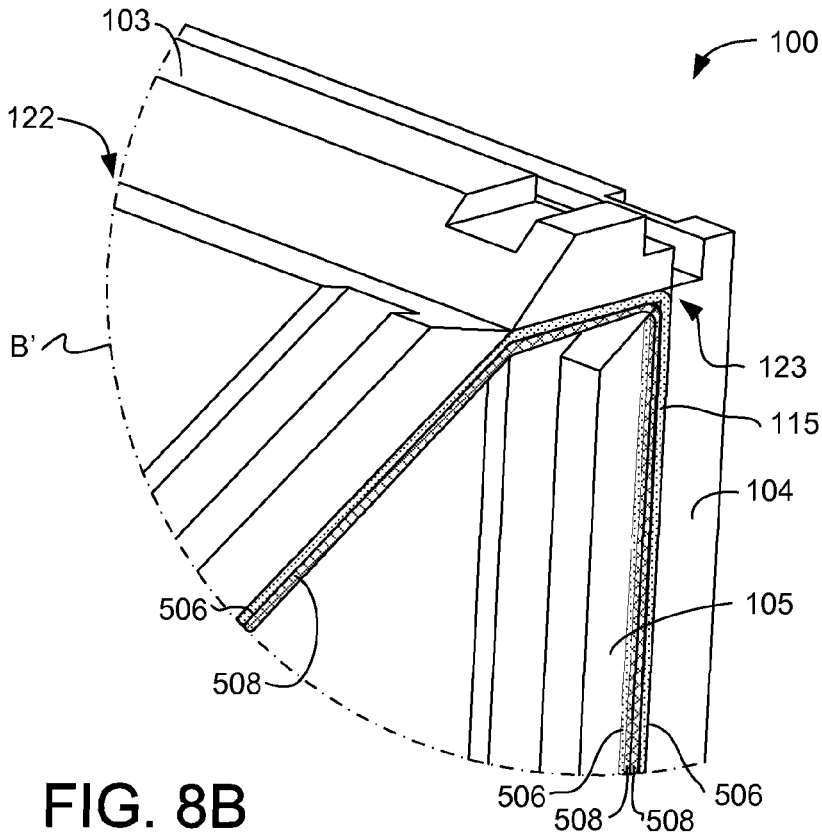
FIG. 8B is a front perspective view illustrating detail B', from FIG. 8A, but for the five-panel foldable portion of the improved shippable speaker enclosure of FIG. 1 and FIG. 5 in a further partially folded configuration, according to an exemplary embodiment of the present invention.

FIG. 8B is a front perspective view illustrating detail B', from FIG. 8A, of the five-panel 101, 102, 103, 104, and 105 foldable portion of the improved shippable speaker enclosure 100 of FIG. 1 in a further partially folded configuration, according to an exemplary embodiment of the present invention. Detail B' shows flat mitered rabbet joint 123 open at 90 degrees of angle. Second outermost panel 105 is folded to have its external surface 405, covered by substrate 506 and covering 508, adjacent to the external surface 404, also covered by substrate 506 and covering 508, of second intermediate panel 104. FIG. 8B illuminates that the exterior length 603 of short middle panel 103 must be at least two times thickness 504, substrate 506 and covering 508, in addition to other constraints.

Figure 9A:
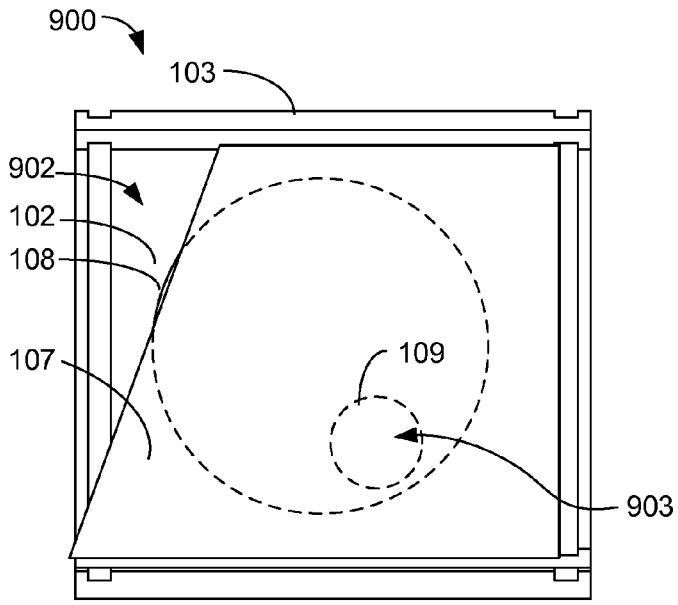
FIG. 9A is a top plan view illustrating the improved shippable speaker enclosure of FIG. 1 in a folded and stacked configuration, according to an exemplary embodiment of the present invention.

FIG. 9A is a top plan view illustrating the improved shippable speaker enclosure 100 of FIG. 1 in a folded and stacked configuration, according to an exemplary embodiment of the present invention. The stack 900 includes the five panels 101, 102, 103, 104, and 105, and the first and second side panels 106 and 107. The advantage of having side panels 106 and 107 no larger in length and width than the largest of the top, front, bottom, and back panels 101, 102, 104, and 105, as shown, is that the first and second side panels 106 and 107 do not make the stack 900 any larger in length or width.

The internal surface 702 of second intermediate panel 102 is preferably adjacent to internal surface 706 of the second intermediate panel 106, such that the speaker opening 108 and the connector cup opening 109 form a stack void 903, in which some construction elements (not likely to mar external surface 707) for the improved shippable speaker enclosure 100 may be shipped. Second side panel 107, with its external surface 407 adjacent to external surface 706 of second intermediate panel 106, closes the stack void 903 and maintains an internal surface 707 on the exterior of the stack 900. An enclosure void 902 is formed which may be used for shipping construction elements with the stack 900 in a rectangular enclosure. Note that, to get the sloped portions of first and second side panels 106 and 107 to line up, either the external surfaces 406 and 407 must be adjacent or the internal surfaces 706 and 707 must be adjacent. The clear preference is for external surfaces 406 and 407 to be adjacent and protected, while the ultimately hidden internal surface 707 is on the exterior of the stack 900.

Figure 9B:
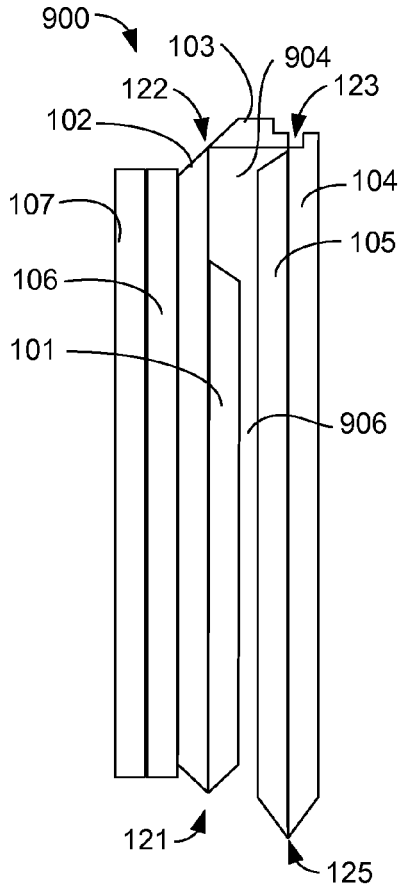
FIG. 9B is a side elevation view illustrating the improved shippable speaker enclosure of FIG. 1 in a folded and stacked configuration, according to an exemplary embodiment of the present invention.

FIG. 9B is a side elevation view illustrating the improved shippable speaker enclosure 100 of FIG. 1 in a folded and stacked configuration, according to an exemplary embodiment of the present invention. Two additional stack voids, 904 and 906 become apparent in this view. Stack void 906 may accommodate a set of instructions 1110 (see FIG. 10), while stack void 904 may accommodate hardware, respectively, for shipping. In the most preferred embodiment, all of the construction elements are shipped in enclosure voids, such as enclosure void 902. At the point where the retail package for the product is filled, the stack 900 may already be bundled or shrink-wrapped, and so use of stack voids 903, 904, and 906 may not always be possible.

Figure 9C:
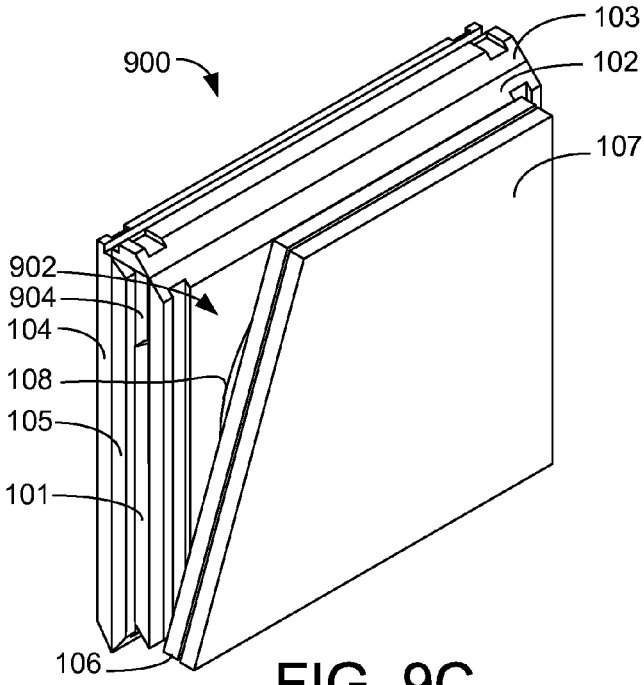
FIG. 9C is a front perspective view illustrating the improved shippable speaker enclosure of FIG. 1 in a folded and stacked configuration, according to an exemplary embodiment of the present invention.

FIG. 9C is a front perspective view illustrating the improved shippable speaker enclosure 100 of FIG. 1 in a folded and stacked configuration, according to an exemplary embodiment of the present invention. The short middle panel 103 must be the middle of the five panels 101, 102, 103, 104, and 105. In various alternate embodiments, the location of the short middle panel 103 may be re-arranged so that the short middle panel 103, instead of being coplanar with the bottom first intermediate panel 104, is coplanar with any one of the second outermost panel 101, second intermediate panel 102, or first outermost panel 105 as long as the assembly joint (125, in the illustrated embodiment) is the third joint away from the short middle panel 103 in both directions. This leaves two foldable panels on each side of the short middle panel 103, and the folding approach of the present invention may be used, as long as the relative length constraints, previously mentioned, are maintained.

Figure 10:
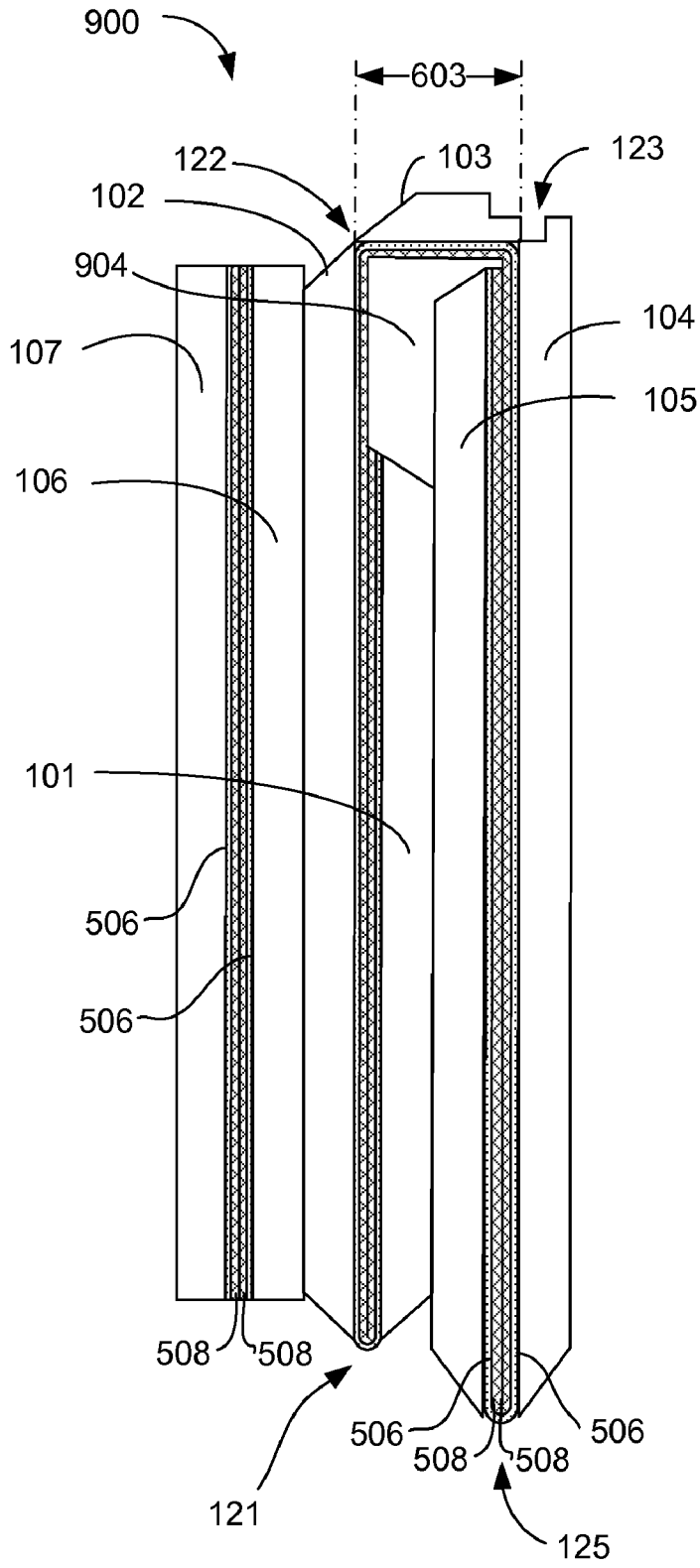
FIG. 10 is a side elevation view illustrating the improved shippable speaker enclosure of FIG. 1 and FIG. 5 in a folded and stacked configuration, according to an exemplary embodiment of the present invention.

FIG. 10 is a side elevation view illustrating the improved shippable speaker enclosure 100 of FIG. 1 and FIG. 5 in a folded and stacked configuration, according to an exemplary embodiment of the present invention. The impact of the thickness of substrate 506 and covering 508 may be clearly seen. The exterior length 603 of short middle panel 103 must be at least four times the combined thickness of the substrate 506 and covering 508, plus twice the panel thickness 502 (or the combined thicknesses of panels 101 and 105, if not such thicknesses are not equal).

Figure 11:
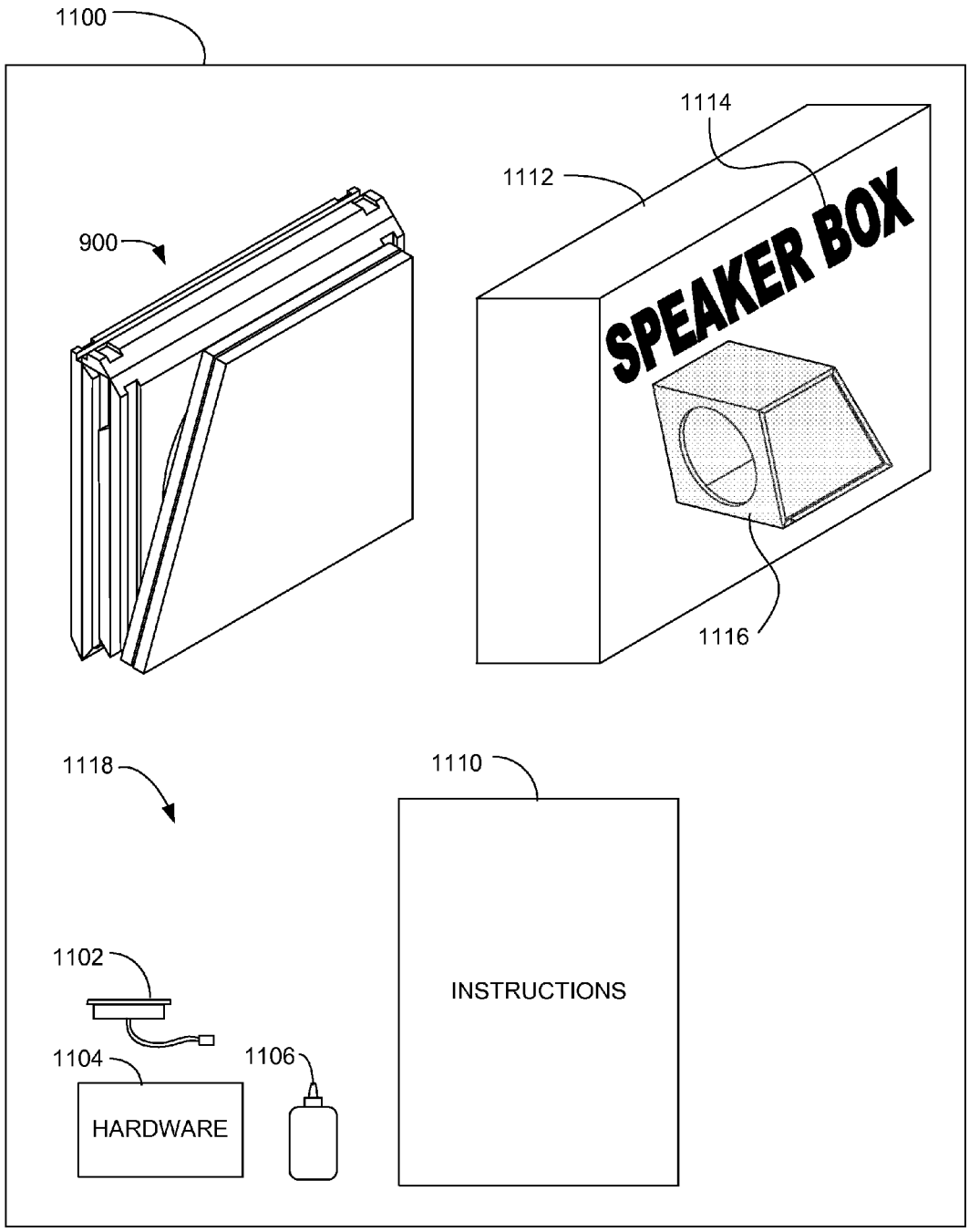
FIG. 11 is a diagrammatic view of a shipping kit for the improved shippable speaker enclosure of FIG. 1, according to an exemplary embodiment of the present invention.

FIG. 11 is a diagrammatic view of a shipping kit 1100 for the improved shippable speaker enclosure 100 of FIG. 1, according to an exemplary embodiment of the present invention. Kit 1100 includes a stack 900, construction elements 1118 for assisting in assembly, and may include a retail package 1112. Construction elements 1118 may include a connector cup 1102, an adhesive 1106, a securer 1402, and a set of instructions 1110. The set of instructions 1110 may include instructions in multiple languages. The adhesive 1106 may be of any type or form appropriate for the materials being adhered. Optional hardware package 1104 may include fasteners 1004, or fasteners 1004 may be included in package 1108. If mounting hardware is used with a particular embodiment, such as to mount the improved shippable speaker enclosure 100 to a wall or ceiling, that hardware may be included in assembly hardware package 1104. In an alternate embodiment, all or part of the set of instructions may be printed on one or more interior surfaces 701, 702, 703,704, 705, 706, and/or 708. If the stack 900 is not bound or shrink-wrapped at the kit 1100 assembly point, at least some of the construction elements 1118 may be packed in stack voids 903, 904, and 906. In a preferred embodiment, construction elements may be packed in enclosure voids, such as enclosure void 902.

Figure 12:
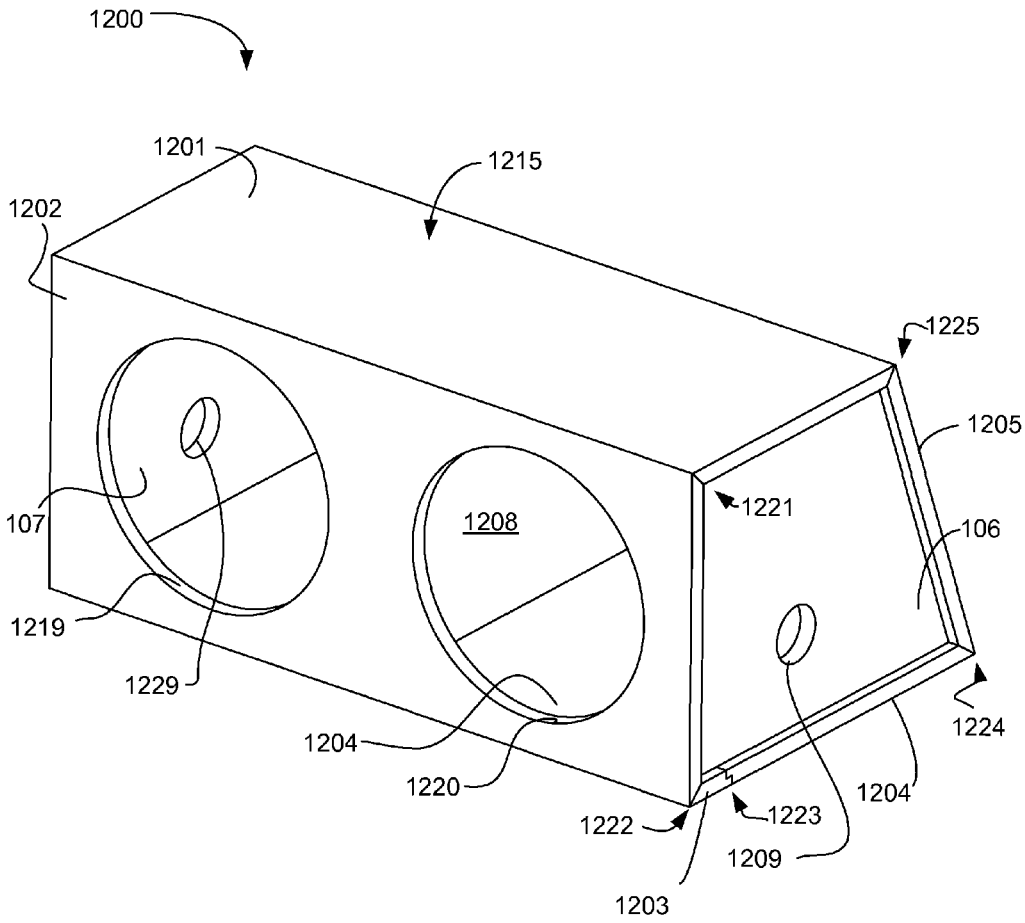
FIG. 12 is a front perspective view illustrating a second embodiment of the improved shippable speaker enclosure, according to an exemplary embodiment of the present invention.

FIG. 12 is a front perspective view illustrating a second embodiment of the improved shippable speaker enclosure 1200, according to an exemplary embodiment of the present invention. Improved shippable speaker enclosure 1200 has two speaker openings 1219 and 1220 in panel 1202. Improved shippable speaker enclosure 1200 comprises a short middle panel 1203, first and second intermediate panels 1204 and 1202, and first and second outermost panels 1205 and 1201 flexibly coupled in a linearly aligned sequence. Short middle panel 1203 is flexibly coupled on a first side to first intermediate panel 1204 using a flexibly coupled flat rabbet joint 1223. First intermediate panel 1204 is flexibly coupled to first outermost panel 1205 using a flexibly coupled mitered joint 1224. Short middle panel 1203 is flexibly coupled on a second side to second intermediate panel 1202 using a flexibly coupled mitered joint 1222. Second intermediate panel 1202 is flexibly coupled to second outermost panel 1201 using a flexibly coupled mitered joint 1221. The four flexible couplings at joints 1221, 1222, 1223, and 1224 are preferably made by affixing a single sheet of substrate 506 over the surfaces of the improved shippable speaker enclosure 1200 that will become exterior surfaces after assembly. The five panels 1201, 1202, 1203, 1204, and 1205 and the four flexible couplings at joints 1221, 1222, 1223, and 1224 form the foldable portion of improved shippable speaker enclosure 1200. Together with first and second side panels 106 and 107, the five panels 1201, 1202, 1203, 1204, and 1205 and the four flexible couplings at joints 1221, 1222, 1223, and 1224 form the improved shippable speaker enclosure. Substrate 506 forms flexible couplings at joints 1221, 1222, 1223, and 1224, but the invention is not so limited.

Partition 1208, an eighth panel, partitions the space inside improved shippable speaker enclosure 1200 into two separate chambers: one for each speaker opening 1219 and 1220. Preferably, each chamber has a connector cup opening 1209, 1229, though the invention is not so limited. Those of skill in the art, enlightened by the present disclosure, will appreciate the vast number of variations of partitions 1208 of the internal spaces in the improved shippable speaker enclosure 1200 that may be made. For example, addition of horizontal partitions might be used with eighth panel 1208 to create four chambers for four speaker openings. In another alternate embodiment, each chamber may have more than one speaker opening 1219, 1220. Very large improved shippable speaker boxes 1200 may be made for rock concert applications or complex speaker arrangements.

Panels 1201, 1202, 1203, 1204, and 1205 are longer than their counterparts in improved shippable speaker enclosure 100. Flexible joints 1221, 1222, 1223, 1224, and 1225 are similar in cross section to their counterparts in improved shippable speaker enclosure 100 but are longer to accommodate the longer panels 1201, 1202, 1203, 1204, and 1205.

Figure 13:
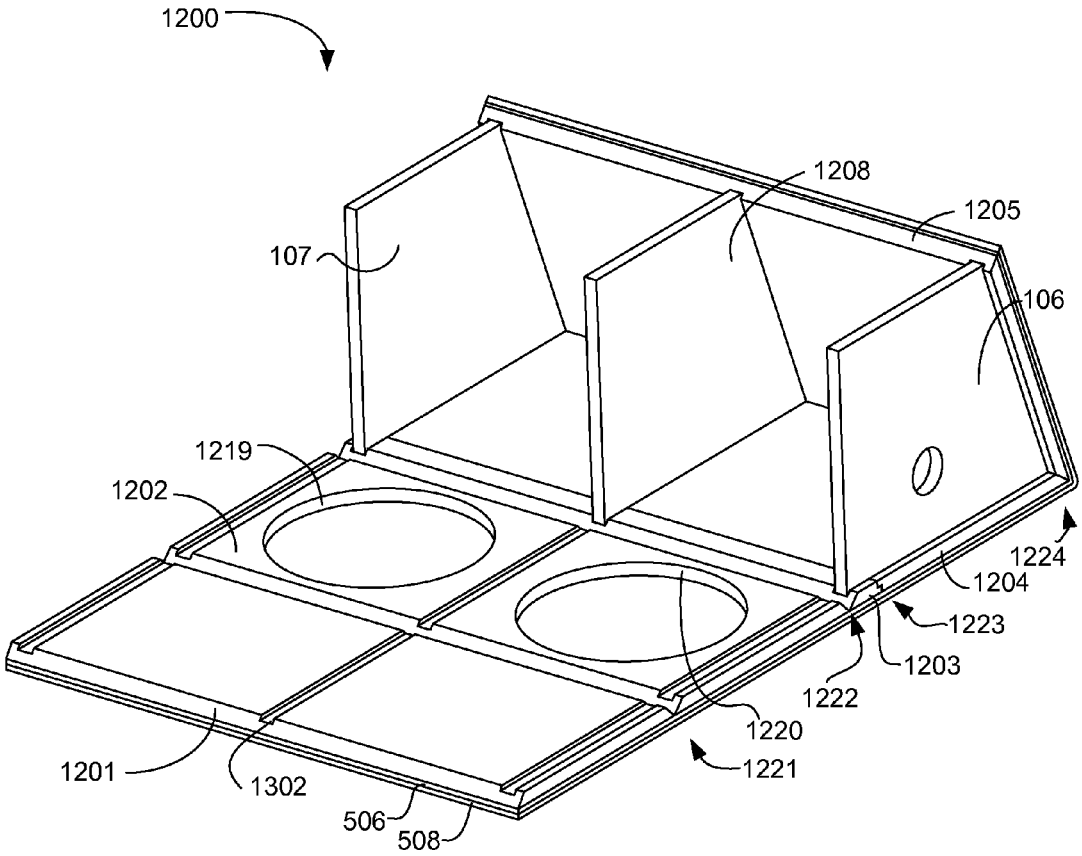
FIG. 13 is a partially unfolded view illustrating the second embodiment of the improved shippable speaker enclosure of FIG. 12, and further illustrating a flexible substrate and covering, according to an exemplary embodiment of the present invention.

FIG. 13 is a partially unfolded view illustrating the second embodiment of the improved shippable speaker enclosure 1200 of FIG. 12, according to an exemplary embodiment of the present invention. Third (central) aligned groove 1302 crosses panels 1201, 1202, 1203, 1204, and 1205 and receives portions of partition 1208 to assist in acoustically separating the two chambers. Partition 1208 is preferably stacked on the outside of the shipping stack, such as stack 900, because any damage to its surface during shipping will not be visible after assembly. In an alternate embodiment having a horizontal partition (not shown), engages an aligned groove through at least four panels. In another alternate embodiment, a partition engaging grooves in three panels may be employed.

Figure 14A:
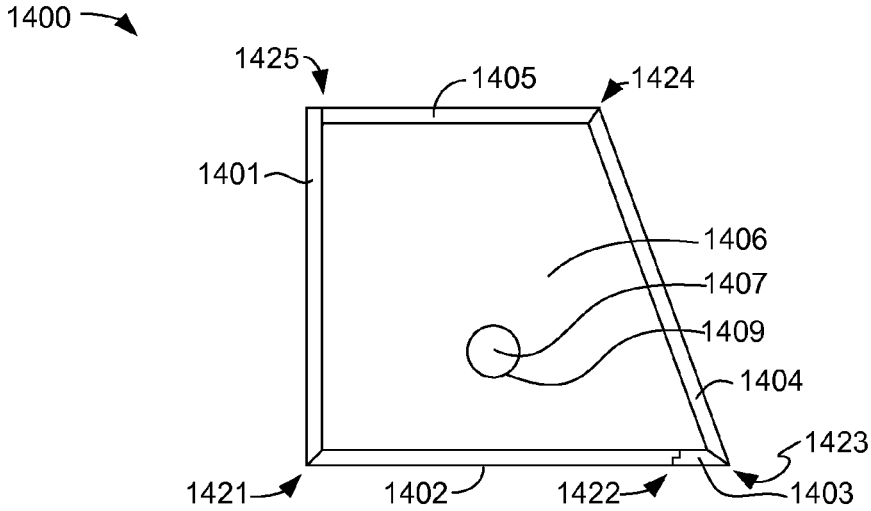
FIG. 14A is a side elevation view illustrating a third embodiment of improved shippable speaker enclosure, according to an exemplary embodiment of the present invention.

FIG. 14A is a side elevation view illustrating a third embodiment 1400 of improved shippable speaker enclosure, according to an exemplary embodiment of the present invention. A novel feature of embodiment 1400, shown assembled, is that short middle panel 1403 is relocated, relative to embodiments 100 and 1200, to proximate the acute mitered joint 1423 and that the open joint 1425 is an abutment joint, rather than a mitered joint. Placing the middle panel 1403 adjacent the acute mitered joint 1423 makes the back panel 1404 the first intermediate panel in the linearly aligned, flexibly coupled, sequence of panels 1401, 1402, 1403, 1404, and 1405. Likewise, the top panel 1405 is now the first outermost panel 1405. Font panel 1401 is the second outermost panel and bottom panel 1402 is the second intermediate panel 1402 in the linearly aligned, flexibly coupled, sequence of panels 1401, 1402, 1403, 1404, and 1405. Rabbet joint 1422 flexibly couples short middle panel 1403 to bottom panel 1402 in the same manner as in the previous embodiments. With short middle panel 1403 adjacent the acute mitered joint 1423, the open joint 1425 must be between the front panel 1401 and the top panel 1405, in order to maintain the connected stacking capability required. The relative size and angle requirements of the previous embodiments 100 and 1200 must be maintained. Flexible coupling joints 1421, 1423, and 1424 are mitered joints. Side panels 1406 and 1407 complete the speaker box 1400. Connector cup opening 1409 in side panel 1406 provides wire leads inside the speaker enclosure 1400 for conducting an audio signal from an audio source to the speaker.

Front panel 1401 is the second outermost panel 1401 and is flexibly coupled to bottom panel 1402, which is the second intermediate panel 1402, by flexibly coupled right-angle mitered joint 1421. Bottom panel 1402 is the second intermediate panel 1402 and is coupled to short middle panel 1403, by flexibly coupled rabbet joint 1422. Short middle panel 1403 is flexibly coupled to back panel 1404, which is the first intermediate panel 1404, by flexibly coupled acute mitered joint 1423. Back panel 1404 is flexibly coupled to the top panel 1405, which is the first outermost panel 1405, by flexibly coupled obtuse mitered joint 1424. Top panel 1405 is fixedly coupled, during assembly by the user or retailer, to front panel 1401 by abutment joint 1425. It will be apparent to those of skill in the art, enlightened by the present disclosure, that joint 1425 may be either as shown or with a shorter front panel 1401 and a longer top panel 1405 such that top panel 1405 rests on top of the end of front panel 1401. The illustrated method is preferred, as the alternative leaves a visible seam on the front face of the speaker cabinet 1400.

Figure 14B:
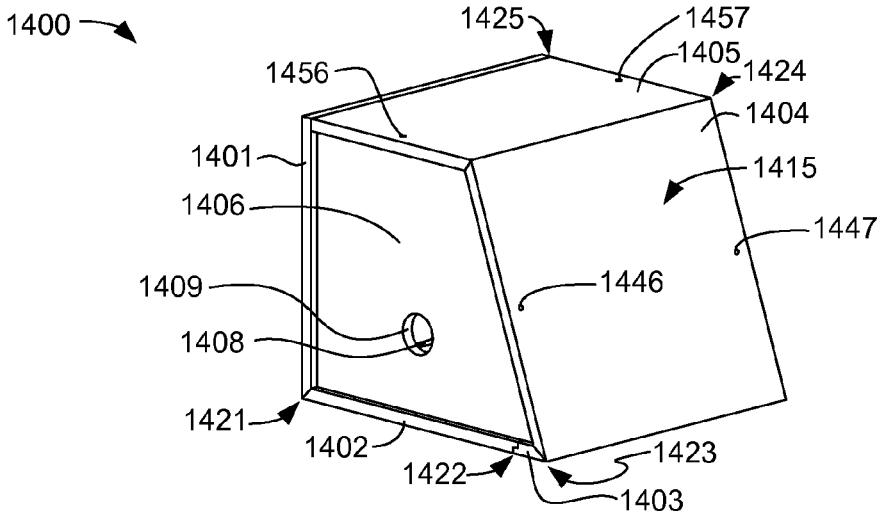
FIG. 14B is a rear-side perspective view illustrating the third embodiment of improved shippable speaker enclosure FIG. 14A, according to an exemplary embodiment of the present invention.

FIG. 14B is a rear-side perspective view illustrating the third embodiment 1400 of improved shippable speaker enclosure FIG. 14A, according to an exemplary embodiment of the present invention. Embodiment 1400 is adapted to a particular type of fastener. On the outside of panels 1401, 1402, 1404, and 1405, bores are drilled to receive screws without engaging the threads of the screws. For convenience in the numbering of the drawings, the numbering convention for a bore is that the tens digit is the ones digit of the panel number in which the bore is made and the ones digit of the bore reference number is the ones digit of the panel number to which the bored panel will connect. For example, bore 1447 is in back panel 1404 for assisting in connecting to second side panel 1407. Bore 1446 in back panel 1404 assists with coupling to first side panel 1406. Bore 1456 in top panel 1405 assists with coupling to first side panel 1406. Bore 1457 in top panel 1405 assists with coupling to second side panel 1407. Speaker opening 1408 in front panel 1401 is sized and shaped to receive a speaker.

Figure 14C:
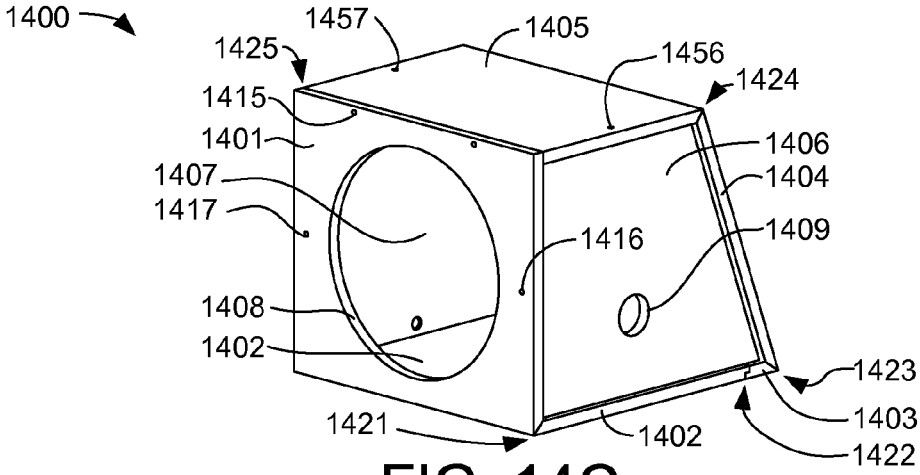
FIG. 14C is a front-side perspective view illustrating the third embodiment of improved shippable speaker enclosure FIG. 14A and FIG. 14B, according to an exemplary embodiment of the present invention.

FIG. 14C is a front-side perspective view illustrating the third embodiment 1400 of improved shippable speaker enclosure FIG. 14A and FIG. 14B, according to an exemplary embodiment of the present invention. Bores 1415 (one of two labeled) in front panel 1401 assist in coupling front panel 1401 to top panel 1405. Bore 1417 in front panel 1401 assists with coupling to second side panel 1407. Bore 1416 in front panel 1401 assists with coupling to first side panel 1406. The fastener patterns as drawn are preferred, but may be altered in various alternate embodiments.

Figure 15A:
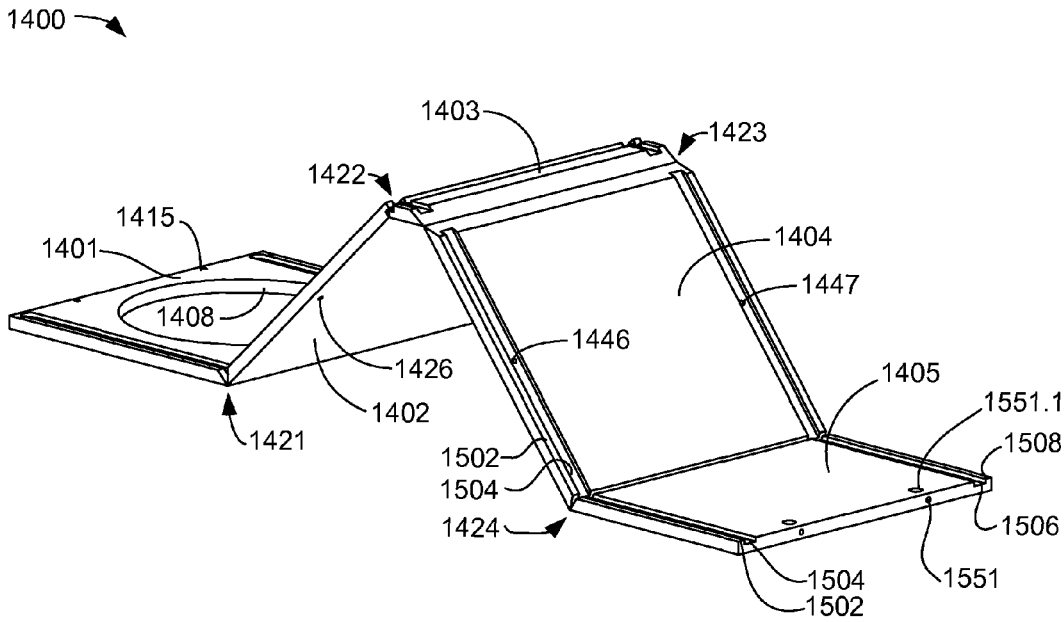
FIG. 15A is a first perspective view illustrating a linearly aligned sequence of five panels of the third embodiment of improved shippable speaker enclosure FIG. of 14A, 14B, according to an exemplary embodiment of the present invention.

FIG. 15A is a first perspective view illustrating a linearly aligned sequence of five panels 1401, 1402, 1403, 1404, and 1405 of the third embodiment 1400 of improved shippable speaker enclosure FIG. of 14A, 14B, and 14C according to an exemplary embodiment of the present invention. Channels 1504 and 1508 are cut on the inside surfaces of panels 1401, 1402, 1403, 1404, and 1405 to receive edges of first and second side panels 1406 and 1407. The channels 1504 and 1508 leave rims 1502 and 1506, respectively. Bores 1446 and 1447 are in channels 1504 and 1508, as shown. Bore 1426 in bottom panel 1402 assists in coupling to first side panel 1406, and emerges in channel 1504, not visible in this view. Bores 1551 (one of two labeled) in the edge of top panel 1405 assists with coupling to front panel 1401. Bores 1415 align with bores 1551 during assembly to assist in coupling front panel 1401 to top panel 1405. Plastic disc 1551.1, inserted in a transverse bore that communicates with bore 1551, engages the threads of the screw (not shown). It is a feature of the invention that only the plastic discs, such as plastic disc 1551.1, engages the threads of the screw, thus enabling the use of panel materials that might not be suitable for fastening with screws.

Figure 15B:
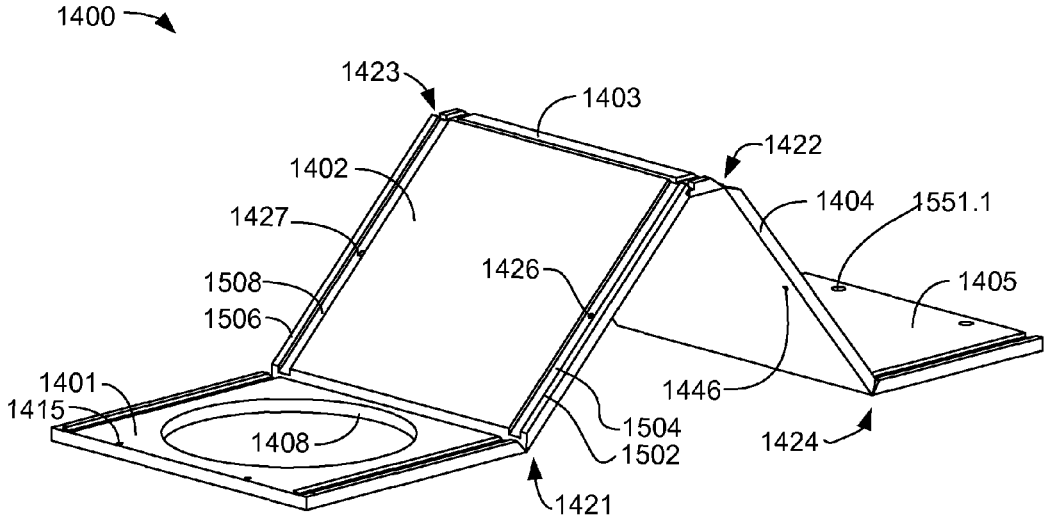
FIG. 15B is a second perspective view illustrating the linearly aligned sequence of five panels of the third embodiment of improved shippable speaker enclosure FIG. of 14A, 14B, according to an exemplary embodiment of the present invention.

FIG. 15B is a second perspective view illustrating the linearly aligned sequence of five panels of the third embodiment of improved shippable speaker enclosure FIG. of 14A, 14B, according to an exemplary embodiment of the present invention. Bore 1427 in channel 1508 of bottom panel 1402 assists in coupling bottom panel 1402 to second side panel 1407. Bore 1426 in channel 1504 of bottom panel 1402 assists in coupling bottom panel 1402 to first side panel 1406.

Figure 15C:
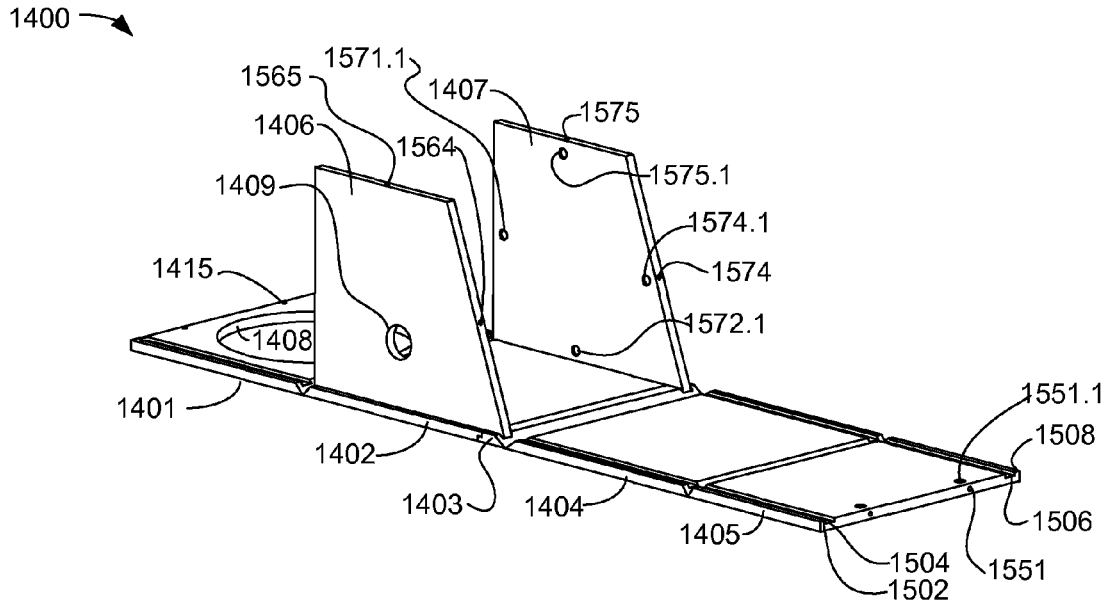
FIG. 15C is a first perspective view illustrating a linearly aligned sequence of five panels with two side panels partially installed for assembling the third embodiment of improved shippable speaker enclosure FIG. of 14A, according to an exemplary embodiment of the present invention.

FIG. 15C is a first perspective view illustrating a linearly aligned sequence of five panels 1401, 1402, 1403, 1404, and 1405 with two side panels 1406 and 1407 partially installed for assembling the third embodiment 1400 of improved shippable speaker enclosure FIG. of 14A, according to an exemplary embodiment of the present invention. Plastic discs 1571.1, 1572.1, 1574.1, and 1575.1 are in bores in panel 1407 transverse to bores 1571, 1572, 1574, and 1575, respectively. Panel 1406 has a mirror image pattern of bores and discs on its inside surface. Bore 1564 in first side panel 1406 assists in coupling first side panel 1406 to back panel 1404. Bore 1565 in first side panel 1406 assists in coupling first side panel 1406 to top panel 1405. Bore 1574 in second side panel 1407 assists in coupling second side panel 1407 to back panel 1404. Bore 1575 in second side panel 1407 assists in coupling second side panel 1407 to top panel 1405.

Figure 15D:
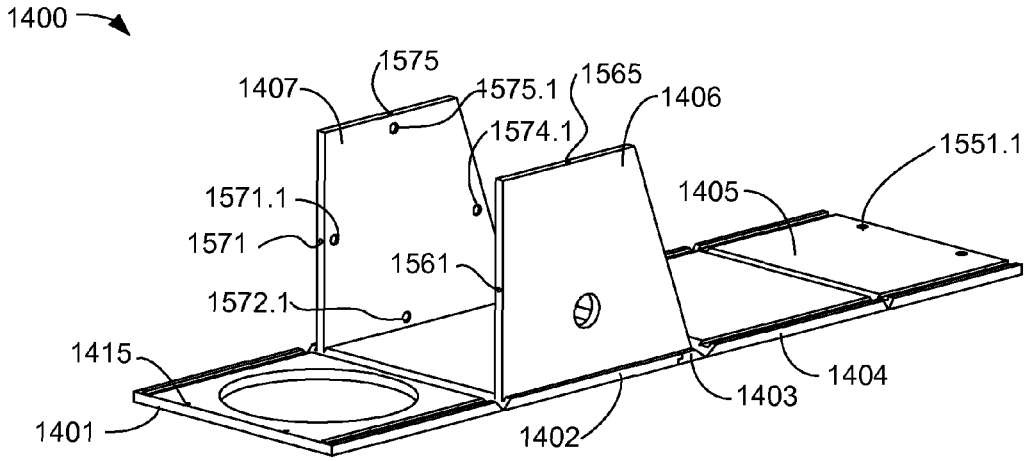
FIG. 15D is a second perspective view illustrating a linearly aligned sequence of five panels with two side panels partially installed for assembling the third embodiment of improved shippable speaker enclosure FIG. of 14A, according to an exemplary embodiment of the present invention.

FIG. 15D is a second perspective view illustrating a linearly aligned sequence of five panels 1401, 1402, 1403, 1404, and 1405 with two side panels 1406 and 1407 partially installed for assembling the third embodiment 1400 of improved shippable speaker enclosure FIG. of 14A, according to an exemplary embodiment of the present invention. Bore 1561 in first side panel 1406 assists in coupling first side panel 1406 to front panel 1401. Bore 1571 in second side panel 1407 assists in coupling second side panel 1407 to front panel 1401.

Figure 15E:
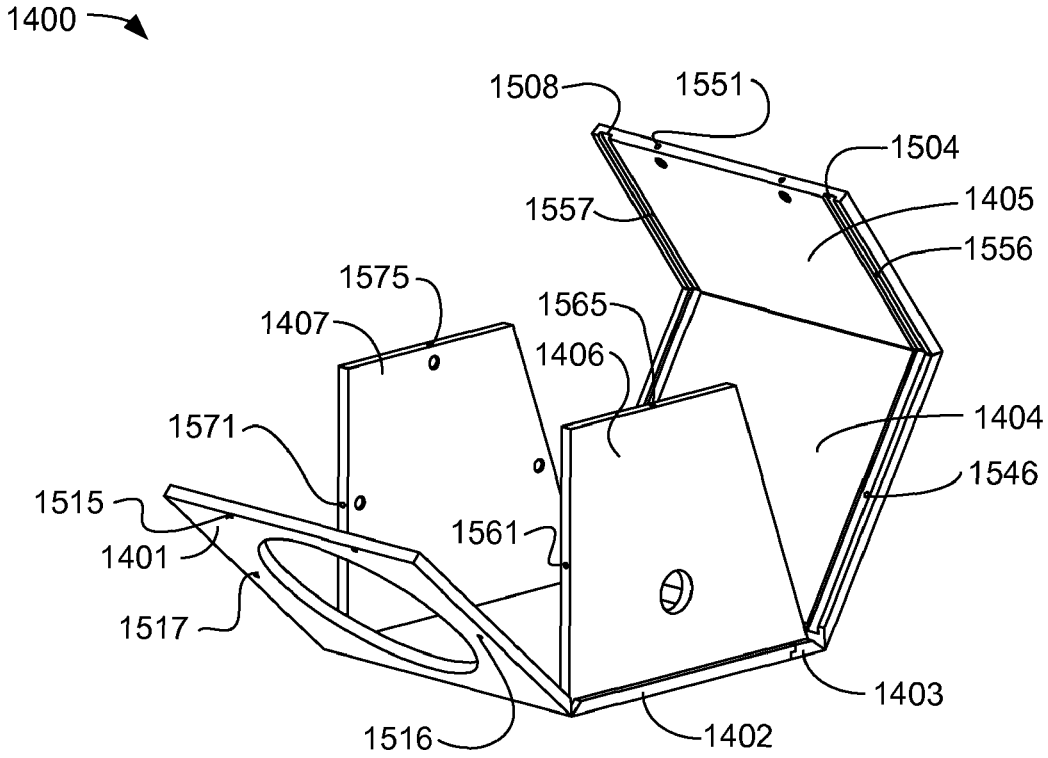
FIG. 15E is a first perspective view illustrating a partially assembled linearly aligned sequence of five panels with two side panels partially installed for assembling the third embodiment of improved shippable speaker enclosure FIG. of 14A, according to an exemplary embodiment of the present invention.

FIG. 15E is a first perspective view illustrating a partially assembled linearly aligned sequence of five panels 1401, 1402, 1403, 1404, and 1405 with first and second side panels 1406 and 1407 partially installed for assembling the third embodiment 1400 of improved shippable speaker enclosure FIG. of 14A, according to an exemplary embodiment of the present invention. Bore 1517 in front panel 1401 assists in coupling front panel 1401 to second side panel 1407. Bore 1517 in front panel 1401 aligns with bore 1571 in panel 1407 during assembly. Bore 1516 in front panel 1401 assists in coupling front panel 1401 to first side panel 1406. Bore 1516 in front panel 1401 aligns with bore 1561 in panel 1406 during assembly. Bore 1557 in top panel 1405 assists in coupling top panel 1405 to second side panel 1407. Bore 1556 in top panel 1405 aligns with bore 1565 in panel 1405 during assembly.

Figure 15F:
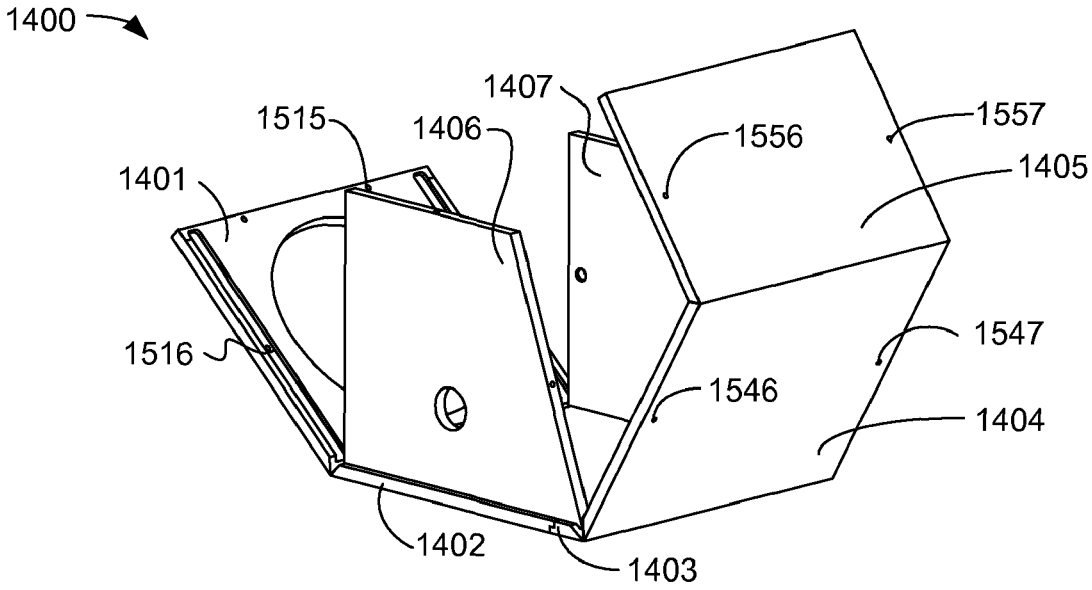
FIG. 15F is a second perspective view illustrating a partially assembled linearly aligned sequence of five panels with two side panels partially installed for assembling the third embodiment of improved shippable speaker enclosure FIG. of 14A, according to an exemplary embodiment of the present invention.

FIG. 15F is a second perspective view illustrating a partially assembled linearly aligned sequence of five panels 1401, 1402, 1403, 1404, and 1405 with two side panels 1406 and 1407 partially installed for assembling the third embodiment 1400 of improved shippable speaker enclosure FIG. of 14A, according to an exemplary embodiment of the present invention. Bore 1547 in back panel 1404 assists in coupling back panel 1405 to second side panel 1407.

Figure 15G:
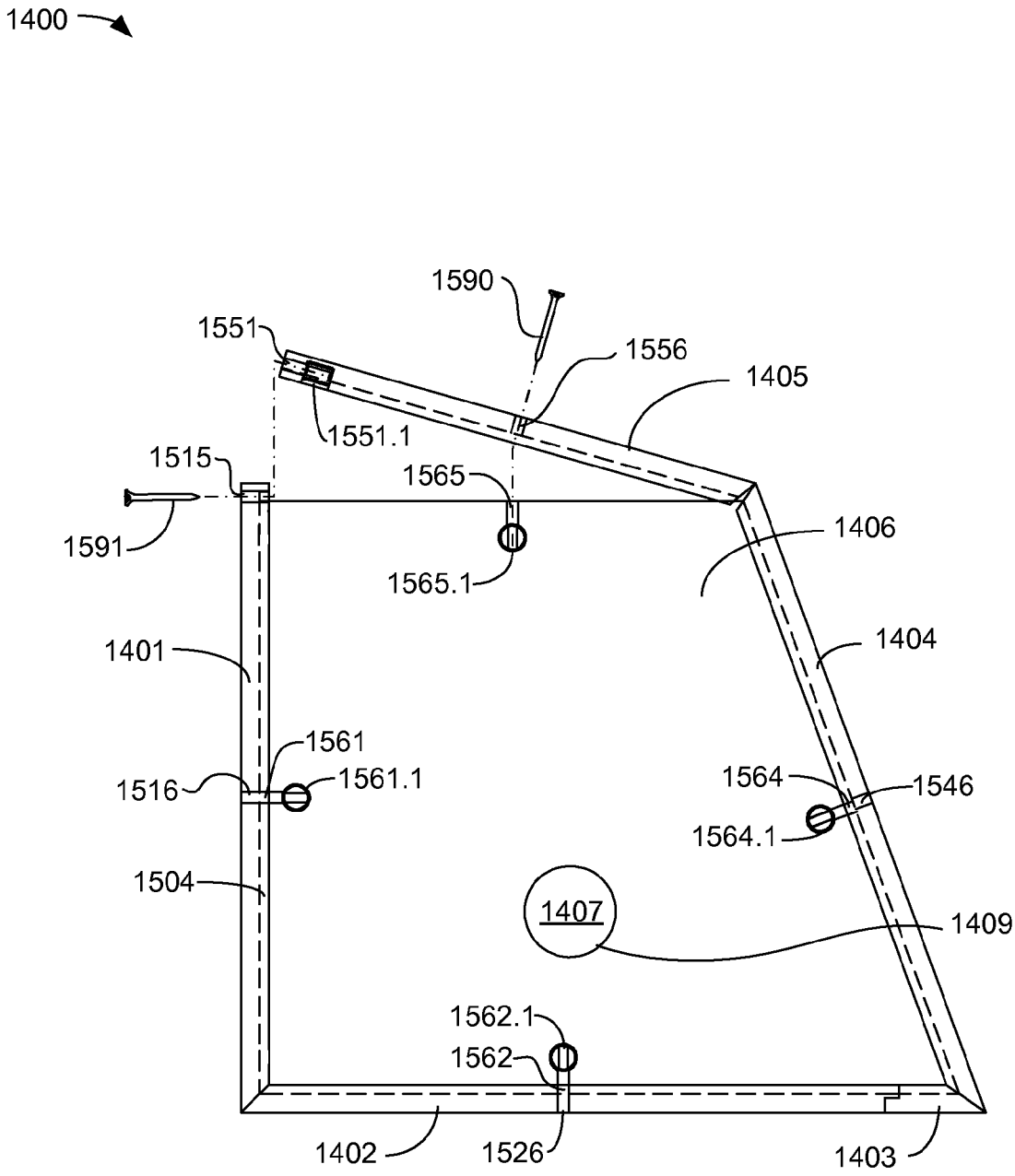
FIG. 15G is a Side elevation x-ray view illustrating the third embodiment of improved shippable speaker enclosure FIG. of 14A, according to an exemplary embodiment of the present invention.

FIG. 15G is a side elevation x-ray view illustrating the third embodiment 1400 of improved shippable speaker enclosure FIG. of 14A, according to an exemplary embodiment of the present invention. The dashed line in FIG. 15G indicates channel 1504. Top panel 1405 is shown incompletely assembled. Bore 1556 in top panel 1405 aligns with bore 1565 in panel 1405 during assembly, and conducts a screw 1590 into plastic disc 1565.1. A dashed and dotted line indicates the connectivity of screw 1590 when the speaker box 1400 is assembled. Bore 1515 in front panel 1401 aligns with bore 1551 in panel 1405 during assembly, and conducts a screw 1591 into plastic disc 1555.1. A dashed and dotted line indicates the connectivity of screw 1591 when the speaker box 1400 is assembled. Bore 1516 in front panel 1401 aligns with bore 1561 in first side panel 1406 during assembly to conduct a screw (not shown) into plastic disc 1561.1. Bore 1526 in bottom panel 1402 aligns with bore 1562 in first side panel 1406 during assembly to conduct a screw (not shown) into plastic disc 1562.1. Bore 1546 in back panel 1404 aligns with bore 1564 in first side panel 1406 during assembly to conduct a screw (not shown) into plastic disc 1564.1.

Figure 16:
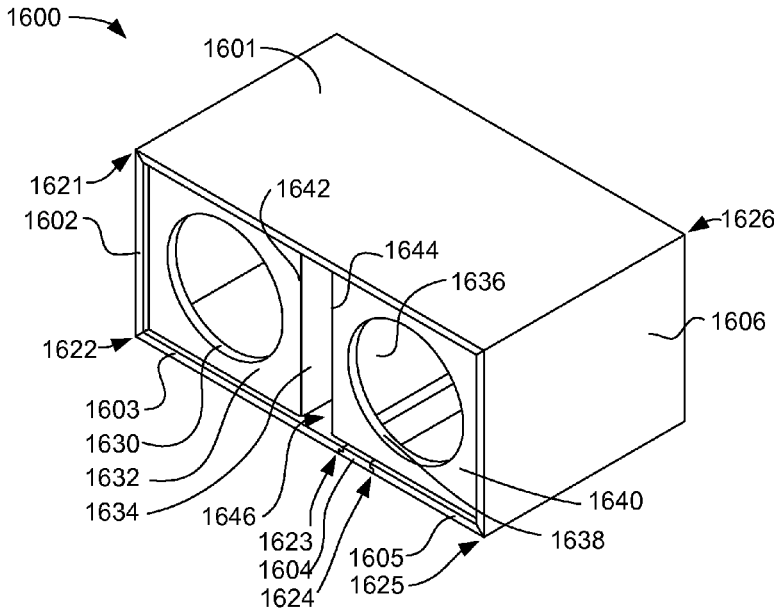
FIG. 16 is a front perspective view illustrating yet another improved shippable speaker enclosure, according to this exemplary embodiment of the present invention.

FIG. 16 is a front perspective view illustrating yet another improved shippable speaker enclosure 1600, according to this exemplary embodiment of the present invention. Improved shippable speaker enclosure 1600 is a two-speaker enclosure with a cavity 1646 between the first and second speaker openings 1630 and 1638. The middle panel 1604 has double rabbet joints 1623 and 1624. Panel 1601 is the top panel, with panel 1602 comprising the right end panel, as shown, and panel 1606 comprising the left end panel, as shown. The bottom includes first bottom panel 1603, middle panel 1604, and second bottom panel 1605. Panels 1601, 1602, 1603, 1604, 1605 and 1606 are flexibly coupled at joints 1621, 1622, 1623, 1624, and 1625 to form a linear sequence of panels 1700 (see FIG. 17), and meet to form an enclosure at joint 1626.

First front panel 1632 has first speaker opening 1630 and is flexibly coupled to first cavity side panel 1634 at joint 1642. Second front panel 1640 has second speaker opening 1638 and is flexibly coupled to cavity side panel 1636 at joint 1644. Cavity 1646 is sized to resonate at a predetermined frequency that depends on the frequency range of the speakers.

Figure 17:
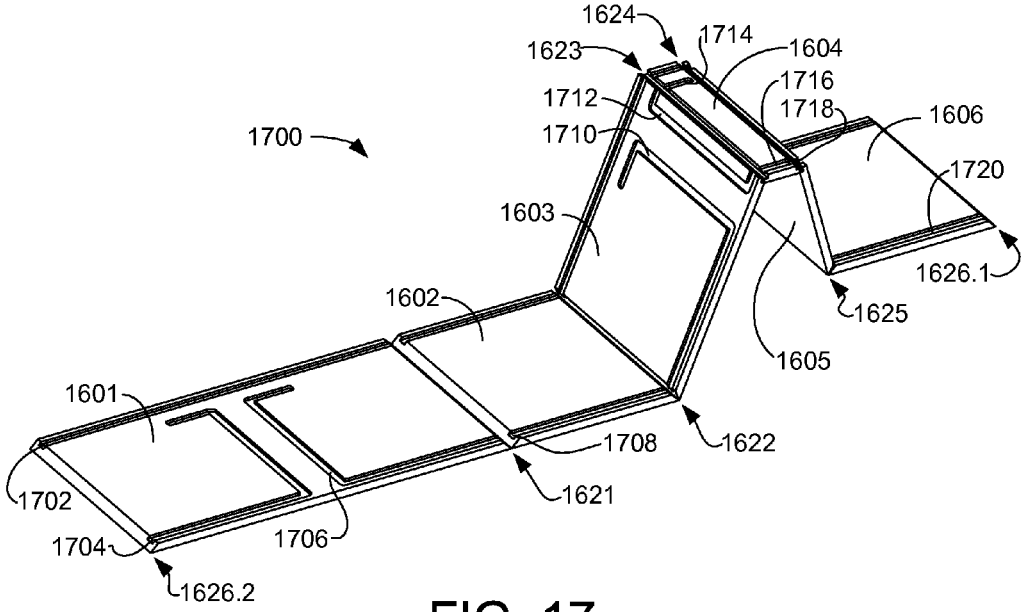
FIG. 17 is a front perspective view illustrating aspects of the improved shippable speaker enclosure of FIG. 16, according to an exemplary embodiment of the present invention.

FIG. 17 is a front perspective view illustrating aspects of the improved shippable speaker enclosure 1600 of FIG. 16, according to an exemplary embodiment of the present invention. Linear sequence of panels 1700 includes flexibly coupled panels 1601-1606. Channel 1702 runs across all panels 1601-1606. Panel 1601 has, on its interior surface, first and second squared J-shaped channels 1704 and 1706 for receiving top edges of first and second speaker holders 1800.2 and 1900.2 (See FIGS. 18B and 19B), respectively. Right end panel 1602 has channel 1708 for receiving an edge of first front panel 1632. First bottom panel 1603 has squared J-shaped channel 1710 for receiving bottom edges of first speaker holder 1800.2. First bottom panel 1603 and middle panel 1604, have channels 1712 and 1714 and 1716, respectively, that form a squared J-shaped channel that extends into second bottom panel 1605 as channel 1718, and receives bottom edges of second speaker holder 1900.2 during assembly. Right end panel 1606 has channel 1720 for receiving an edge of second speaker holder 1900.2 during assembly. Ends 1626.1 and 1626. 2 of the linear sequence of panels 1700 will meet, when assembled, to form joint 1626.

The linear sequence of panels 1700 may be described by their linear sequence, as well as the positional nomenclature provided above. Middle panel 1604 is in linear alignment with and flexibly coupled to first intermediate panel (first bottom panel) 1603 and to second intermediate panel (second bottom panel) 1605. Second intermediate panel (second bottom panel) 1605 is in linear alignment with and flexibly coupled to second outermost panel (right end panel) 1606. First intermediate panel (first bottom panel) 1603 is in linear alignment with and flexibly coupled to first extension panel (left end panel) 1602. First extension panel (left end panel) 1602 is in linear alignment with and flexibly coupled to first outermost panel (top panel) 1601.

Figure 18A:
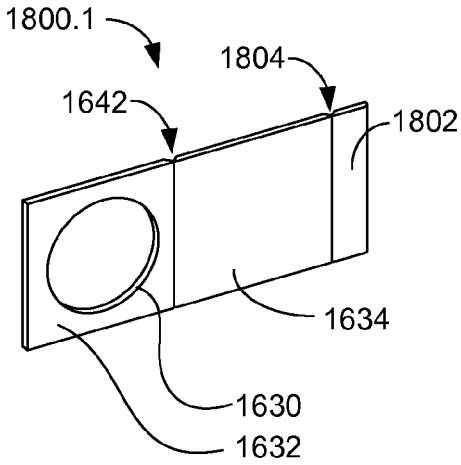
FIG. 18A is a front perspective view illustrating aspects of a speaker enclosure of the improved shippable speaker enclosure of FIG. 16, according to an exemplary embodiment of the present invention.

FIG. 18A is a front perspective view illustrating aspects of a speaker holder 1800.1 of the improved shippable speaker enclosure 1600 of FIG. 16, according to an exemplary embodiment of the present invention. Shown in flat, stackable form, speaker holder 1800.1 is a linear sequence of three panels. First front panel 1632 is flexibly coupled to first cavity side panel 1634 at joint 1642. First cavity side panel 1634 is flexibly coupled to first support panel 1802 by joint 1804.

Figure 18B:
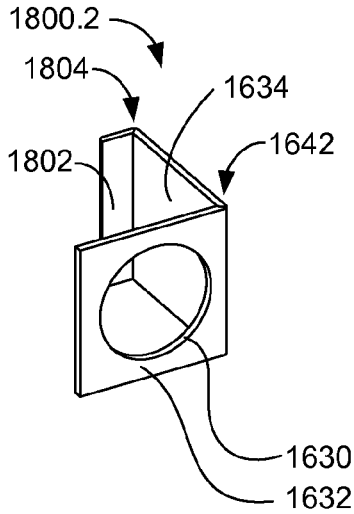
FIG. 18B is a front perspective view illustrating aspects of the speaker enclosure of FIG. 18A of the improved shippable speaker enclosure of FIG. 16, according to an exemplary embodiment of the present invention.

FIG. 18B is a front perspective view illustrating aspects of the speaker holder 1800.2 of FIG. 18A of the improved shippable speaker enclosure 1600 of FIG. 16, according to an exemplary embodiment of the present invention. First speaker holder 1800.2 is speaker holder 1800.1 in a folded configuration. Each joint 1642 and 1804 is flexed to a 90° angle, and may be glued in this position as part of assembly.

Figure 19A:
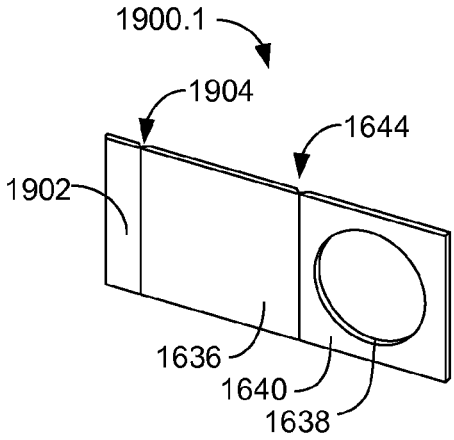
FIG. 19A is a front perspective view illustrating aspects of a speaker enclosure of the improved shippable speaker enclosure of FIG. 16, according to an exemplary embodiment of the present invention.

FIG. 19A is a front perspective view illustrating aspects of a speaker holder 1900.1 of the improved shippable speaker enclosure 1600 of FIG. 16, according to an exemplary embodiment of the present invention. Shown in flat, stackable form, speaker holder 1900.1 is a linear sequence of three panels. Second front panel 1640 is flexibly coupled to second cavity side panel 1636 at joint 1644. Second cavity side panel 1636 is flexibly coupled to second support panel 1902 by joint 1904.

Figure 19B:
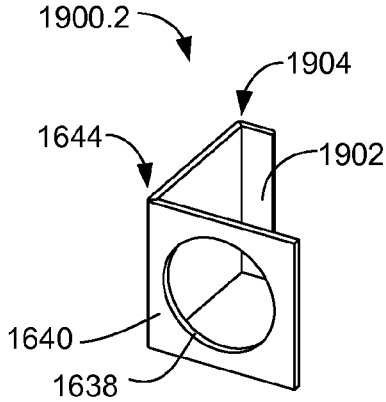
FIG. 19B is a front perspective view illustrating aspects of the speaker enclosure of FIG. 19A of the improved shippable speaker enclosure of FIG. 16, according to an exemplary embodiment of the present invention.

FIG. 19B is a front perspective view illustrating aspects of the speaker holder 1900.2 of FIG. 19A of the improved shippable speaker enclosure 1600 of FIG. 16, according to an exemplary embodiment of the present invention. Second speaker holder 1900.2 is speaker holder 1900.1 in a folded configuration. Each joint 1644 and 1904 is flexed to a 90° angle, and may be glued in this position as part of assembly.

Figure 20:
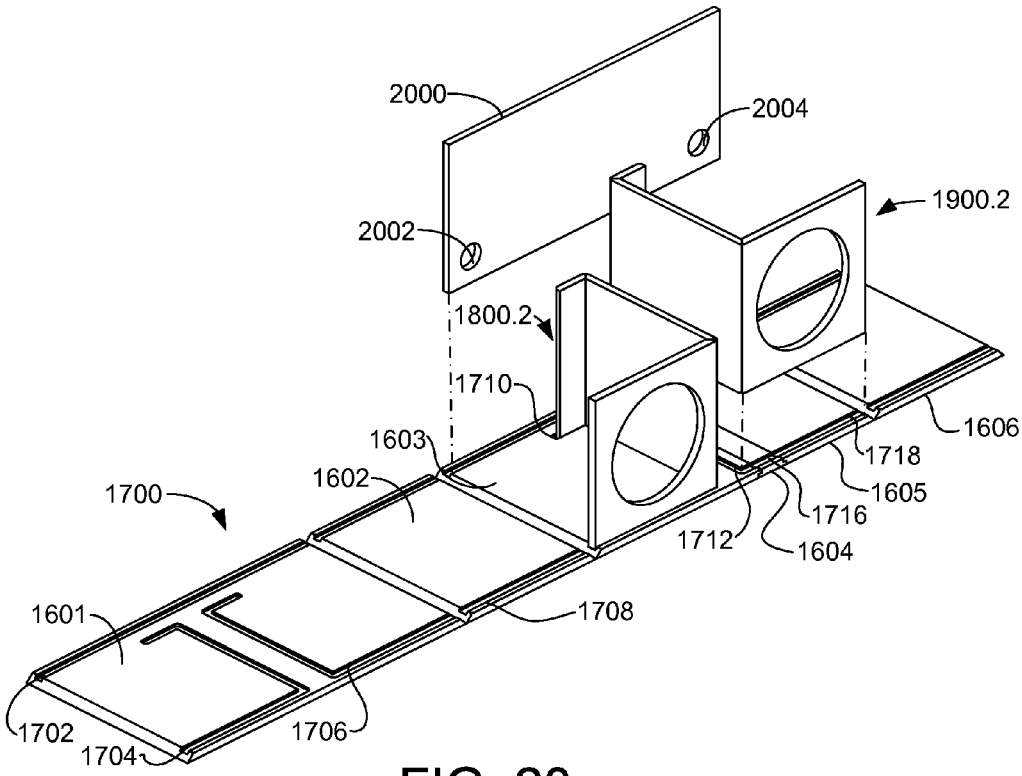
FIG. 20 is a front perspective view illustrating aspects of the improved shippable speaker enclosure of FIG. 16 during assembly, according to an exemplary embodiment of the present invention.

FIG. 20 is a front perspective view illustrating aspects of the improved shippable speaker enclosure 1600 of FIG. 16 during assembly, according to an exemplary embodiment of the present invention. Linear sequence of panels 1700 is laid flat and first speaker holder 1800.2 is inserted, along its bottom edges, into squared J-shaped channel 1710. Second speaker holder 1900.2 is aligned, along its bottom edges, with a squared J-shaped channel formed by channels 1712, 1714, 1716, and 1718. Back panel 2000, with first and second connector cup openings 2002 and 2004, is aligned to channel 1702 in panels 1603, 1604, and 1605.

Figure 21:
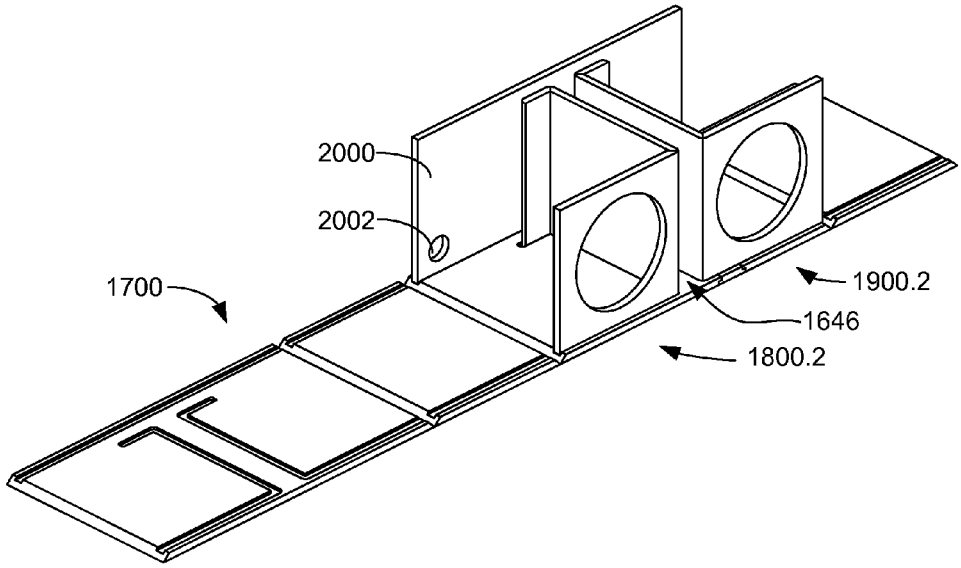
FIG. 21 is a front perspective view illustrating aspects of the improved shippable speaker enclosure of FIG. 16 in a further stage of assembly, according to an exemplary embodiment of the present invention.

FIG. 21 is a front perspective view illustrating aspects of the improved shippable speaker enclosure 1600 of FIG. 16 in a further stage of assembly, according to an exemplary embodiment of the present invention. Second speaker holder 1900.2 is inserted, along its bottom edges, into the squared J-shaped channel formed by channels 1712, 1714, 1716, and 1718. Back panel 2000, with first and second connector cup openings 2002 and 2004, is inserted to channel 1702 in panels 1603, 1604, and 1605.

Figure 22:
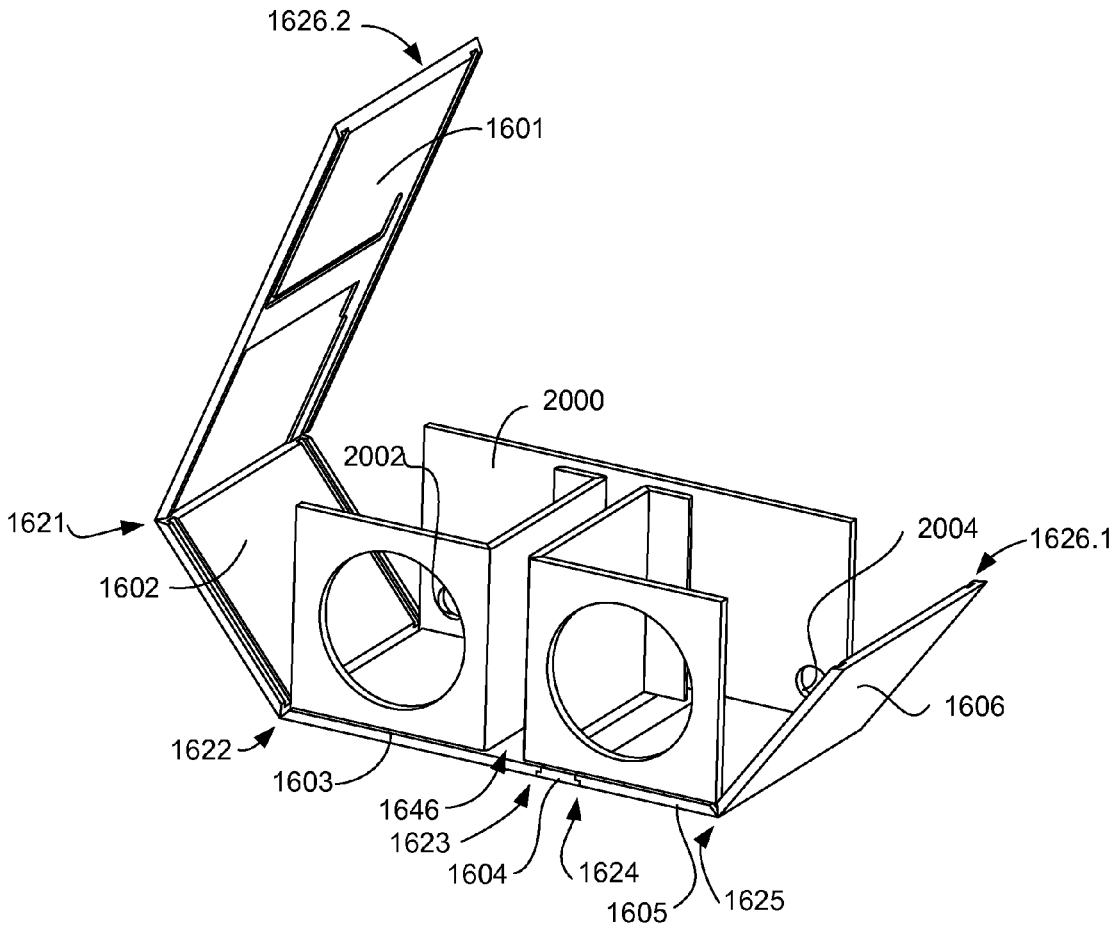
FIG. 22 is a front perspective view illustrating aspects of the improved shippable speaker enclosure of FIG. 16 in a yet a further stage of assembly, according to an exemplary embodiment of the present invention.

FIG. 22 is a front perspective view illustrating aspects of the improved shippable speaker enclosure 1600 of FIG. 16 in a yet a further stage of assembly, according to an exemplary embodiment of the present invention. Flexible couplings, or joints, 1621, 1622, and 1625 are flexed toward 90° angles to bring ends 1626.1 and 1621.2 together to form joint 1626.

Figure 23:
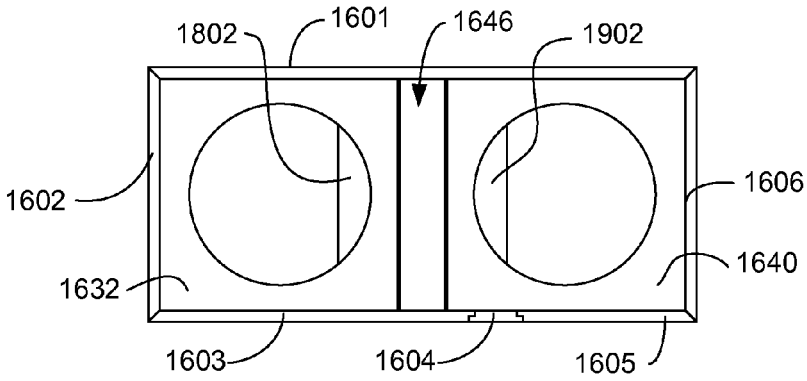
FIG. 23 is a front elevation view illustrating aspects of the improved shippable speaker enclosure of FIG. 16, according to an exemplary embodiment of the present invention.

FIG. 23 is a front elevation view illustrating aspects of the improved shippable speaker enclosure 1600 of FIG. 16, according to an exemplary embodiment of the present invention. Backpressure sound escapes between back panel 2000 and first support panel 1802 and between back panel 2000 and second support panel 1902. The escaping backpressure sound further escapes through cavity 1646, where cavity-resonant frequencies are preferentially passed.

Figure 24:
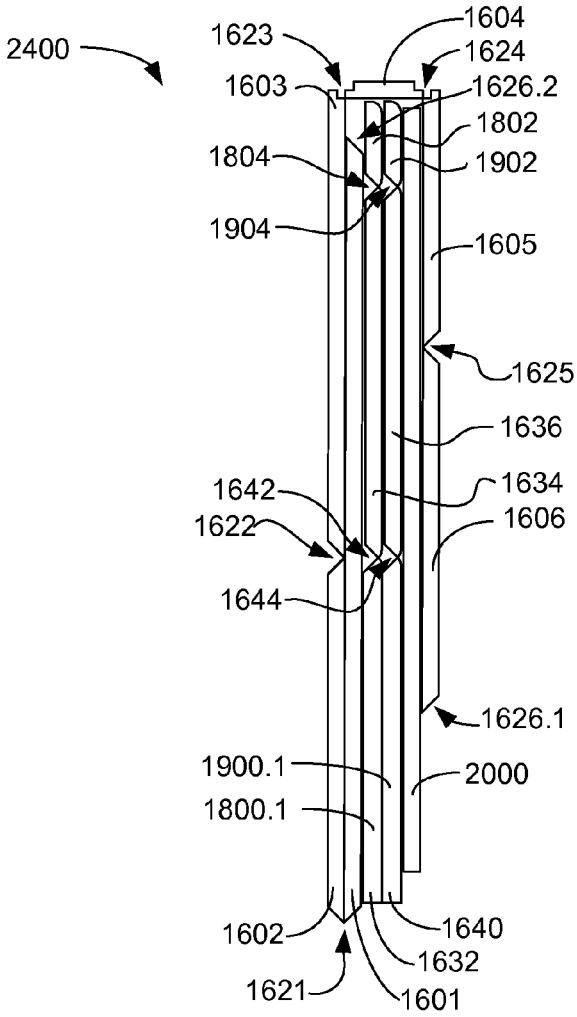
FIG. 24 is a side elevation view illustrating aspects of the improved shippable speaker enclosure of FIG. 16 in a folded configuration, according to an exemplary embodiment of the present invention.

FIG. 24 is a side elevation view illustrating aspects of the improved shippable speaker enclosure 1600 of FIG. 16 in a stacked configuration 2400, according to an exemplary embodiment of the present invention. Rabbet joints 1623 and 1624, on opposing sides of central small panel 1604 are opened to 90° allowing panels 1603 and 1602 to hang vertically from rabbet joint 1623 and allowing panels 1605 and 1606 to hang vertically from rabbet joint 1624. Joint 1622, between panel 1603 and 1602, is not flexed, but joint 1621, between panel 1602 and panel 1601, is flexed backward 180°, folding panel 1601 so that the exterior surface of panel 1601 abuts the external surfaces of panels 1602 and 1603. Joint 1625 is not flexed. First and second speaker holders 1800.1 and 1900.1 (flat), and back panel 2000 are stacked between panel 1601 and the combination of panels 1605 and 1606 to complete the stack 2400.

Figure 25:
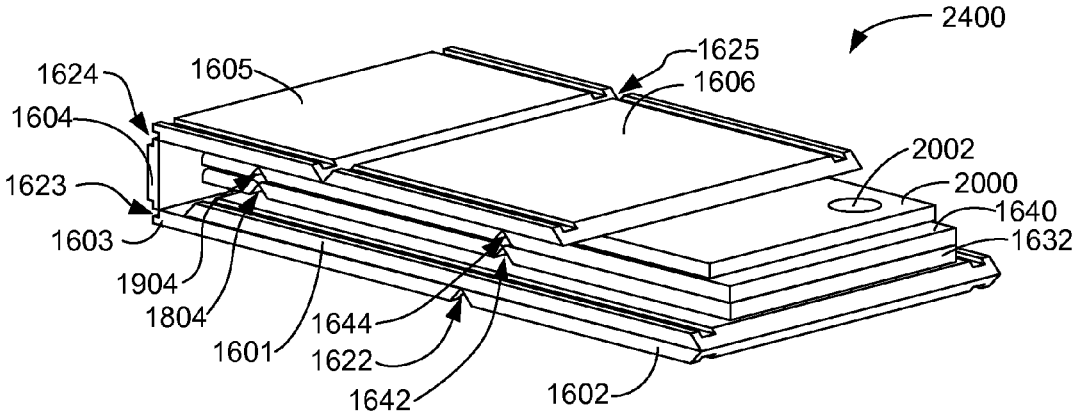
FIG. 25 is a front perspective view illustrating aspects of the improved shippable speaker enclosure of FIG. 16 in the folded configuration of FIG. 24, according to an exemplary embodiment of the present invention.

FIG. 25 is a front perspective view illustrating aspects of the improved shippable speaker enclosure 1600 of FIG. 16 in the stacked configuration 2400 of FIG. 24, according to an exemplary embodiment of the present invention. The stack 2400 maintains surfaces that will ultimately be internal to the speaker enclosure 1600 on the exterior of the stack 2400, so that the risk of marring ultimately exterior surfaces during shipment is reduced. The exterior length of middle panel 1604 is sufficient to accommodate the thickness of four items (back panel 2000, first and second speaker holders 1800.1 and 1900.1 (flat), and panel 1601, as well as the flexible couplings, which may include a flexible substrate, similar to flexible substrate 506, and the thicknesses of any covering, similar to covering 115, on panels 1601-1606, 1632, 1634, 1636, 1802, 1902, and 1640. Other necessary size relationships between the panels 1601-1606, 1632, 1634, 1636, 1802, 1902, and 1640 may be determined from the drawings and discussions relating to previous embodiments.

Speaker enclosure 1600 may be sold in a kit, similar to kit 1100, comprising the stack as shown in FIG. 25 and a retail package containing the stack. The kit for speaker enclosure 1600 may also include hardware, adhesive, instructions, clamps, and connector cups. In a particular embodiment, speakers may also be included in the kit for speaker enclosure 1600.

Figure 26:
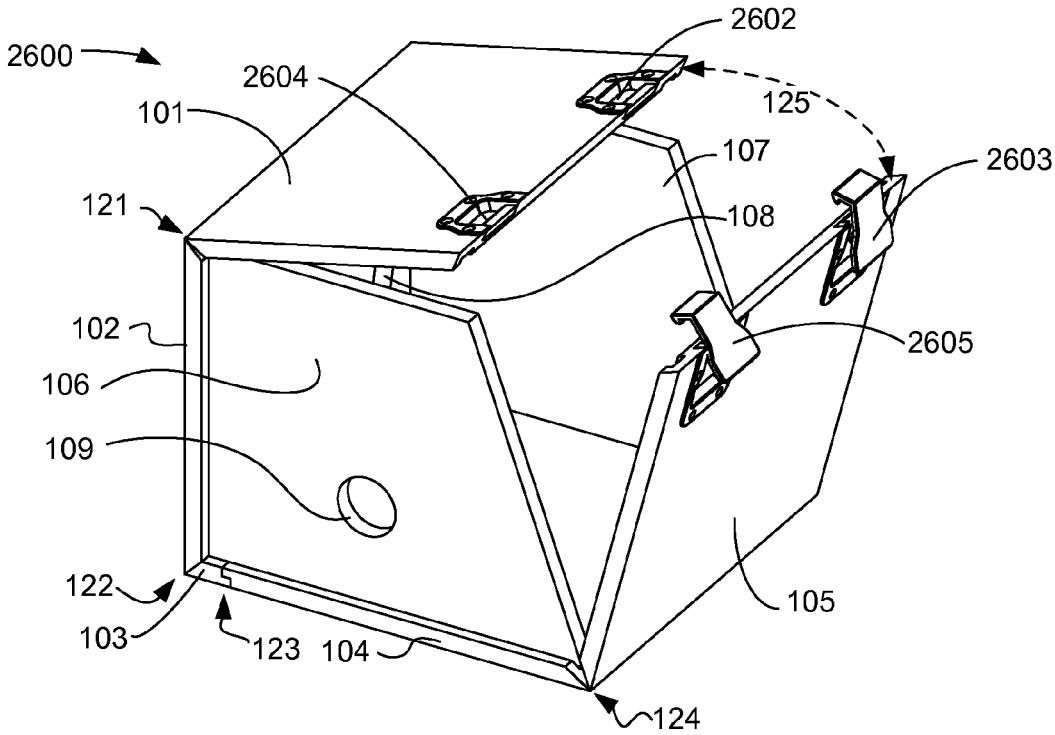
FIG. 26 is a front perspective view illustrating aspects of an alternate embodiment of the improved shippable speaker enclosure of FIG. 2, according to this exemplary embodiment of the present invention.

FIG. 26 is a front perspective view illustrating aspects of an alternate embodiment 2600 of the improved shippable speaker enclosure 100 of FIG. 2, according to this exemplary embodiment of the present invention. First two-piece clamp 2602-2603 has a clamp receiver 2602 on panel 101 at a first edge of joint 125 and a clamp engager 2603 on panel 105 at a second edge of joint 125. The clamp receiver 2602 and clamp engager 2603 operate together to clamp joint 125 securely shut. Second two-piece clamp 2604-2605 has a clamp receiver 2604 on panel 101 at a first edge of joint 125 and a clamp engager 2605 on panel 105 at a second edge of joint 125. The clamp receiver 2604 and clamp engager 2605 operate together to clamp joint 125 securely shut. Clamps of various alternate designs may be used in various alternate embodiments.

Figure 27:
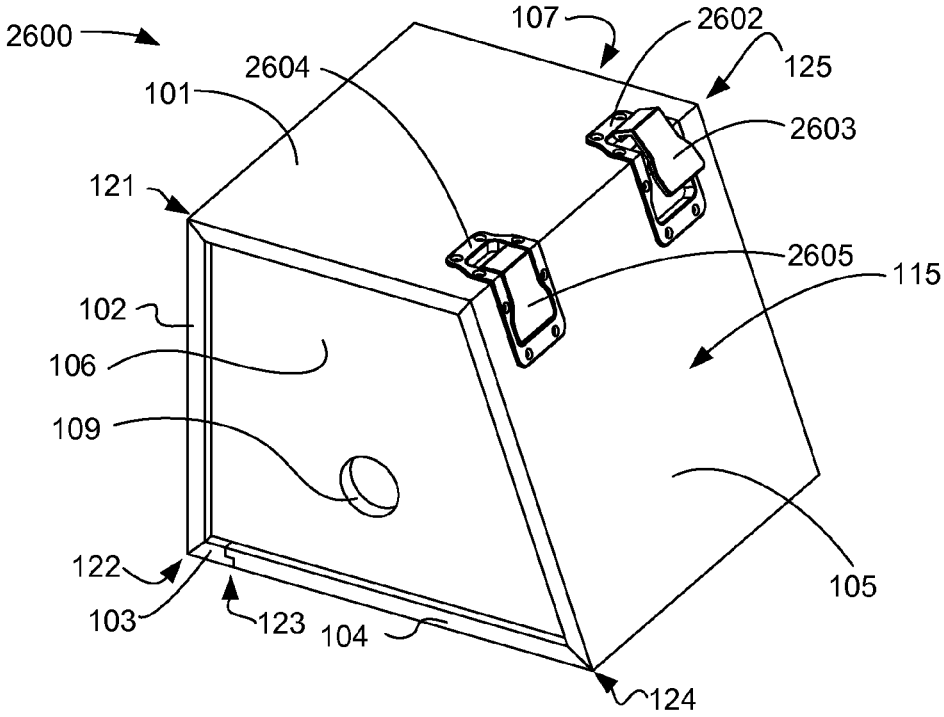
FIG. 27 is a front perspective view illustrating aspects of the alternate embodiment of the improved shippable speaker enclosure of FIG. 2, according to this exemplary embodiment of the present invention.

FIG. 27 is a front perspective view illustrating aspects of the alternate embodiment 2600 of the improved shippable speaker enclosure 100 of FIG. 2, according to this exemplary embodiment of the present invention. First two-piece clamp 2602-2603 is shown in a position of initial engagement of the clamp receiver 2602 by the clamp engager 2603. Second two-piece clamp 2604-2605 is shown in a position of final engagement of the clamp receiver 2602 by the clamp engager 2603. In a particular embodiment, the joint 125 may be glued in addition to being clamped.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims, as interpreted in light of the specification and the legal equivalents thereof.

What is claimed is:

1. An improved shippable speaker enclosure, comprising:

a) five panels flexibly coupled in a linearly aligned sequence with four flexible couplings formed by a flexible substrate adhered to each of said five panels, comprising:
   i. a middle panel comprising four sides;
   ii. first and second intermediate panels, each flexibly coupled to said middle panel on one of two opposite sides of said four sides, in said linearly aligned sequence;
   iii, first and second outermost panels, each flexibly coupled to one respective said intermediate panel in said linearly aligned sequence;
   iv. a covering adhered to said substrate;
   v. said five panels operable to be folded together into a configuration where said first and second intermediate panels and said first and second outermost panels are stacked generally parallel to each other without uncoupling said four flexible couplings;

b) a sixth panel, comprising a first side panel sized and shaped to be circumferentially engaged by said five panels;

c) a seventh panel, comprising a second side panel sized and shaped to be circumferentially engaged by said five panels, wherein said five panels, said sixth panel, and said seventh panel comprise seven panels operable to be assembled into said improved shippable speaker enclosure;

d) said five panels, foldable into said configuration wherein four panels of said five panels are parallel and said four flexible couplings remain coupled; and e) said sixth and said seventh panels are stackable parallel to said four parallel panels to form a stack.

2. The improved shippable speaker enclosure of claim 1, further comprising at least one eighth panel operable, in assembly of said speaker enclosure, to partition space interior to said speaker enclosure into at least two separate portions to accommodate at least two corresponding speakers.

3. The improved shippable speaker enclosure of claim 1, combined in a kit comprising:

a) said five panels, folded into said configuration wherein four panels of said five panels are parallel and said four flexible couplings remain coupled; and b) said sixth and said seventh panels stacked parallel to said four parallel panels to form a stack.

4. The improved shippable speaker enclosure of claim 3, wherein said kit further comprises:

a) at least one fastener for fastening at least two said panels together; and b) at least one construction element comprising an adhesive.

5. The improved shippable speaker enclosure of claim 1, further comprising a covering adhered to said flexible substrate.

6. The improved shippable speaker enclosure of claim 3, wherein:

a) each of said five panels have a whole panel thickness, wherein said whole panel thickness comprises the combined thickness of said panel plus a thickness of said flexible substrate adhered to said panel, plus a thickness of said covering;

b) wherein said middle panel comprises:
   i. an external length greater than combined said thicknesses of said first and second outermost panels; and
   ii. an external length less than external lengths of each of said first and second intermediate panels and each of said first and second outermost panels.

7. The improved shippable speaker enclosure of claim 6, wherein said first and second outermost panels have smaller external lengths than respective said first and second intermediate panels to which said first and second outermost panels are respectively flexibly coupled.

8. The improved shippable speaker enclosure of claim 3, wherein:

a) at least one of said sixth panel and said seventh panel comprises a connector cup opening positioned to be alignable to at least one speaker opening in said stack;

b) said kit further comprises a connector cup sized, shaped, and arranged to fit securely within said connector cup opening; and c) at least one panel of said five panels comprises said, a least one speaker opening.

9. The improved shippable speaker enclosure of claim 8, wherein said kit further comprises a retail package:

a) operable to contain:
   i. said stack;
   ii. said at least one construction element;
   iii. said connector cup; and
   iv. said at least one fastener; and b) bearing, on at least one surface of said retail package, at least one of:
   i. text relating to said speaker enclosure; and
   ii. graphics relating to said speaker enclosure.

10. The improved shippable speaker enclosure of claim 3, wherein said at least one construction element of said kit comprises at least one of:

a) at least one adhesive, operable to at least adhere said side panels to said five panels;

b) assembly hardware for at least one of:
i. mounting said assembled speaker enclosure;
ii. mounting a speaker within said speaker enclosure; and
iii. assembling said speaker enclosure; and
c) at least one set of instructions illustrating and explaining how to assemble said speaker enclosure.

11. The improved shippable speaker enclosure of claim 1, further comprising first and second aligned grooves in each panel of said five panels, wherein said first and second grooves are configured to receive at least a portion of said first and said second side panels, respectively.

12. The improved shippable speaker enclosure of claim 11, further comprising at least one third groove across at least four panels of said seven panels, said at least one third groove operable to at least partially receive at least one eighth panel, wherein said at least one eighth panel is operable, when said speaker enclosure is assembled, as a partition interior to said speaker enclosure.

13. The improved shippable speaker enclosure of claim 1, wherein said four flexible couplings comprise one piece of flexible substrate coupled to at least four of said five panels.

14. An improved shippable speaker enclosure, comprising:
a) five panels flexibly coupled in a linearly aligned sequence with four flexible couplings;
b) wherein said five panels are operable to be folded together into a stacked configuration wherein four panels of said five panels are stacked generally parallel to each other without uncoupling said four flexible couplings;
c) wherein each of said five panels have a whole panel thickness comprising a thickness of said panel plus a thickness of said flexible substrate plus a thickness of a covering, wherein said covering is one of affixed to said panel and affixed to said substrate;
d) wherein said five panels comprise:
i. one middle panel having first and second sides;
ii. first and second intermediate panels flexibly coupled to said middle panel on respective first and second sides of said middle panel;
iii. first and second outermost panels flexibly coupled to respective first and second said intermediate panels to form said linearly aligned sequence; and
e) wherein said middle panel comprises:
an external length greater than the sum of said whole panel thicknesses of said first and second outermost panels;
ii, an external length less than external lengths of each of said first and second intermediate panels and each of said first and second outermost panels; and
iii, wherein said first and second outermost panels have smaller external lengths than said respective first and second intermediate panels to which said first and second outermost panels are respectively flexibly coupled;
f) a sixth panel, comprising a first side panel sized and shaped to be circumferentially engaged by said five panels;
g) a seventh panel, comprising a second side panel sized and shaped to be circumferentially engaged by said five panels, wherein said five panels, said sixth panel, and said seventh panel comprise seven panels operable to be assembled into said improved shippable speaker enclosure;
h) first and second aligned grooves in each panel of said five panels, wherein said first and second grooves are configured to receive at least a portion of said first and said second side panels, respectively;
i) wherein one of said sixth panel and said seventh panel comprises a connector cup opening;
j) wherein at least one of said first and second intermediate panels and said first and second outermost panels comprises at least one speaker opening;
k) wherein said five panels are operable to be folded to form said speaker enclosure by:
i. circumferentially engaging edges of said sixth and said seventh panels; and
ii. being secured thereto with at least one of:
1. adhesive, operable to adhere said sixth and seventh side panels to said five panels; and
2. at least one fastener, operable to secure said speaker enclosure in an assembled state;
l) wherein said five panels are operable to be folded for shipping into said stacked configuration and said sixth panel and said seventh panel are operable to be stacked parallel and adjacent to said five folded panels to form a stack.

15. The improved shippable speaker enclosure of claim 14, further comprising at least one third groove across at least four panels of said seven panels, said at least one third groove operable to receive at least one eighth panel, wherein said at least one eighth panel is operable, when said speaker enclosure is assembled, as a partition interior to said speaker enclosure.

16. The improved shippable speaker enclosure of claim 14, combined in a kit comprising:
a) said stack; and
b) a retail package containing said stack.

17. The improved shippable speaker enclosure of claim 16, wherein said kit further comprises at least one construction element comprising at least one of:
a) said adhesive, operable to at least adhere said side panels to said five panels;
b) assembly hardware for at least one of:
i. mounting said assembled speaker enclosure;
ii. mounting a speaker within said speaker enclosure; and
iii. assembling said speaker enclosure; and
c) at least one set of instructions illustrating and explaining how to assemble said speaker enclosure; and
d) said at least one fastener, operable to secure said speaker enclosure in an assembled state.

18. An improved shippable speaker enclosure, comprising:
a) five panels flexibly coupled in a linearly aligned sequence with four flexible couplings, wherein said four flexible couplings comprise one piece of flexible substrate coupled to said five panels;
b) wherein said five panels are operable to be folded together into a folded configuration wherein four panels of said five panels are stacked generally parallel to each other without uncoupling said four flexible couplings;
c) said five linearly arranged panels comprise:
i. one middle panel comprising first and second opposing sides;
ii. first and second intermediate panels flexibly coupled to said middle panel on said respective first and second opposing sides of said middle panel;
iii. first and second outermost panels flexibly coupled to respective said first and second intermediate panels to form said linearly aligned sequence; and
d) wherein said middle panel comprises:
i. an external length at least as great as the sum of whole panel thicknesses of each of said first and second outermost panels combined, wherein said whole panel thickness comprises a thickness of said panel plus a thickness of said substrate plus a thickness of said covering;

ii. an external length less than external lengths of each of said first and second intermediate panels and each of said first and second outermost panels;

iii. each said first and second outermost panel further comprising a smaller external length than said respective first and second intermediate panel to which each said first and second outermost panel is coupled;

e) a sixth panel, comprising a first side panel sized and shaped to be circumferentially engaged by said five panels;

f) a seventh panel, comprising a second side panel sized and shaped to be circumferentially engaged by said five panels, wherein said five panels, said sixth panel, and said seventh panel comprise seven panels operable to be assembled into said improved shippable speaker enclosure;

g) wherein said five panels comprise first and second aligned grooves in each panel of said five panels, wherein said first and second aligned grooves are configured to receive a portion of said first and said second side panels, respectively, h) wherein one of said sixth panel and said seventh panel comprises a connector cup opening;

i) wherein at least one of said five panels comprises a speaker opening sized, shaped, and located to receive a speaker;

j) wherein said five panels are operable to be folded about said flexible couplings to form said speaker enclosure by:

i. circumferentially engaging said sixth and said seventh panels; and ii. being secured thereto by a fastener;

k) wherein said five panels are operable to be folded about said flexible couplings into said folded configuration and said sixth panel and said seventh panel are operable to be stacked parallel and adjacent to said five folded panels to form a stack;

l) said stack combined in a kit further comprising:

i. said at least one fastener, operable to secure said speaker enclosure in an assembled state;

ii. said connector cup, operable to provide electrical connections between a speaker and an audio signal source; and iii. at least one of:

1. said adhesive, operable to adhere said sixth and seventh side panels to said five panels;

2. assembly hardware for at least one of:

a. mounting said assembled speaker enclosure;

b. mounting a speaker within said speaker enclosure; and c. assembling said speaker enclosure; and 3. at least one set of instructions illustrating and explaining how to assemble said speaker enclosure; and 4. a retail package, operable to contain said stack, said at least one fastener, said assembly hardware, and said at least one set of instructions.

19. The improved shippable speaker enclosure of claim 18, further comprising:

a) at least one eighth panel operable, when said speaker enclosure is assembled, to partition space within said assembled speaker enclosure; and b) at least one third aligned grove across at least four panels of said seven panels, operable to receive at least a portion of said at least one eighth panel.

20. An improved shippable speaker enclosure, comprising:

a) six panels flexibly coupled in a linearly aligned sequence with five flexible couplings, wherein said five flexible couplings comprise one piece of flexible substrate coupled to said six panels;

b) wherein said six panels are operable to be folded together into a stacked configuration wherein five panels of said six panels are stacked generally parallel to each other without uncoupling said five flexible couplings;

c) said six linearly arranged panels comprise:

i. one middle panel comprising first and second opposing sides comprising a portion of first and second rabbet joints, respectively;

ii. first and second intermediate panels flexibly coupled to said middle panel on said respective first and second opposing sides of said middle panel;

iii. an extension panel flexibly coupled to said first intermediate panel and in linear alignment with said first intermediate panel;

iv. first and second outermost panels flexibly coupled to respective said extension panel and said second intermediate panel to form said linearly aligned sequence.

21. The improved shippable speaker enclosure of claim 20, further comprising first and second speaker holders, each comprising three panels coupled by two flexible couplings in linearly aligned sequence, operable to:

a) be stacked parallel to said five panels when said five panels are in said folded configuration for shipping; and b) be folded at said two flexible couplings for assembly of said speaker enclosure.

22. The improved shippable speaker enclosure of claim 21, further comprising a back panel having first and second connector cup openings and operable to:

a) be stacked parallel to said five panels when said five panels are in said folded configuration for shipping, thereby forming a stack; and b) be assembled as a back panel for said speaker enclosure.

23. The improved shippable speaker enclosure of claim 22, wherein said assembled speaker enclosure comprises a resonant cavity between said speaker holders, said resonant cavity operable to receive backpressure sound from first and second speakers installed in said speaker enclosure and to emit sound out the front of said speaker enclosure.

24. The improved shippable speaker enclosure of claim 22, combined in a kit comprising:

a) said stack; and b) a retail package containing said stack.

* * * * *